US011735355B2

(12) United States Patent
Furukawa

(10) Patent No.: US 11,735,355 B2
(45) Date of Patent: Aug. 22, 2023

(54) INDUCTOR AND PRODUCING METHOD THEREOF

(71) Applicant: NITTO DENKO CORPORATION, Osaka (JP)

(72) Inventor: Yoshihiro Furukawa, Osaka (JP)

(73) Assignee: NITTO DENKO CORPORATION, Osaka (JP)

( * ) Notice: Subject to any disclaimer, the term of this patent is extended or adjusted under 35 U.S.C. 154(b) by 534 days.

(21) Appl. No.: 16/648,173

(22) PCT Filed: Sep. 5, 2018

(86) PCT No.: PCT/JP2018/032853
§ 371 (c)(1),
(2) Date: Mar. 17, 2020

(87) PCT Pub. No.: WO2019/058967
PCT Pub. Date: Mar. 28, 2019

(65) Prior Publication Data

US 2020/0265991 A1 Aug. 20, 2020

(30) Foreign Application Priority Data

Sep. 25, 2017 (JP) ..... 2017-183405

(51) Int. Cl.
*H01F 27/28* (2006.01)
*H01F 27/29* (2006.01)
(Continued)

(52) U.S. Cl.
CPC ..... *H01F 27/292* (2013.01); *H01F 17/04* (2013.01); *H01F 27/022* (2013.01);
(Continued)

(58) Field of Classification Search
CPC ..... H01F 27/292; H01F 17/04; H01F 27/022; H01F 27/245; H01F 27/2866;
(Continued)

(56) References Cited

U.S. PATENT DOCUMENTS 5,852,866 A * 12/1998 Kuettner ..... H01F 41/046 336/200
6,042,899 A * 3/2000 Ishiguro ..... H01L 23/5227 427/372.2
(Continued)

FOREIGN PATENT DOCUMENTS

CN 1542935 A 11/2004
CN 101266869 A 9/2008
(Continued)

OTHER PUBLICATIONS

International Search Report Issued in PCT/JP2018/032853 dated Dec. 11, 2018.
(Continued)

*Primary Examiner* — Mang Tin Bik Lian
(74) *Attorney, Agent, or Firm* — Edwards Neils LLC; Jean C. Edwards, Esq.

(57) ABSTRACT

An inductor includes a wire having a width W, and a first electrode and a second electrode continuous to each of both ends of the wire. The wire, the first electrode, and the second electrode are present on the same plane. The plane area S1 of the first electrode and the plane area S2 of the second electrode are a square value ($W^2$) or more of the width W. An area in which the wire is disposed is positioned between the first electrode and the second electrode. The area has a length X in a longitudinal direction equal to a length L between the first electrode and the second electrode along a facing direction of the first electrode and the second electrode, and a length Y in a short-length direction in a direction perpendicular to the longitudinal direction. The length X in
(Continued)

the longitudinal direction is 1.5 times or more of the length Y in the short-length direction.

7 Claims, 13 Drawing Sheets

(51) Int. Cl.
*H01F 17/04* (2006.01)
*H01F 27/02* (2006.01)
*H01F 27/245* (2006.01)
*H01F 27/32* (2006.01)

(52) U.S. Cl.
CPC ..... *H01F 27/245* (2013.01); *H01F 27/2866* (2013.01); *H01F 27/324* (2013.01)

(58) Field of Classification Search
CPC ..... H01F 27/324; H01F 2017/0066; H01F 17/0006; H01F 41/046; H01F 27/2852; H01F 27/29; H01F 41/04
See application file for complete search history.

(56) References Cited

U.S. PATENT DOCUMENTS

| | | | | |
|---|---|---|---|---|
| 9,431,166 | B2 | 8/2016 | Shijo et al. | |
| 2001/0024739 | A1 | 9/2001 | Mizoguchi et al. | |
| 2010/0157565 | A1 | 6/2010 | Yoshida et al. | |
| 2010/0182116 | A1* | 7/2010 | Ishimoto | H01F 27/366 336/192 |
| 2011/0285493 | A1 | 11/2011 | Smith | |
| 2013/0249662 | A1* | 9/2013 | Tonoyama | H01F 17/0013 336/200 |
| 2014/0009254 | A1* | 1/2014 | Ohkubo | H01F 17/0033 336/192 |
| 2014/0062638 | A1* | 3/2014 | Sasamori | H01F 27/292 29/605 |
| 2014/0077914 | A1* | 3/2014 | Ohkubo | H01F 5/00 75/255 |
| 2015/0002256 | A1 | 1/2015 | Bourns et al. | |
| 2016/0293301 | A1* | 10/2016 | Choto | H01F 17/0013 |
| 2016/0372246 | A1 | 12/2016 | Otsubo et al. | |
| 2017/0169929 | A1* | 6/2017 | Kubik | H01F 17/0013 |

FOREIGN PATENT DOCUMENTS

| | | | |
|---|---|---|---|
| CN | 101326597 | A | 12/2008 |
| CN | 101894656 | A | 11/2010 |
| CN | 102026479 | A | 4/2011 |
| CN | 102479601 | A | 5/2012 |
| CN | 102592817 | A | 7/2012 |
| CN | 103280298 | A | 9/2013 |
| CN | 105359233 | A | 2/2016 |
| CN | 106068542 | A | 11/2016 |
| CN | 107146680 | A | 9/2017 |
| DE | 3908896 | A1 | 9/1989 |
| JP | S57-051247 | B2 | 11/1982 |
| JP | H01-139413 | U | 9/1989 |
| JP | H07-086039 | A | 3/1995 |
| JP | H09-180937 | A | 7/1997 |
| JP | 2001-244123 | A | 9/2001 |
| JP | 2007-019333 | A | 1/2007 |
| JP | 2011-071457 | A | 4/2011 |
| JP | 5082675 | B2 | 9/2012 |
| JP | 2014-013815 | B2 | 1/2014 |
| JP | 2014-229739 | A1 | 12/2014 |
| TW | 201227766 | A1 | 7/2012 |
| WO | 2012/169162 | A1 | 12/2012 |
| WO | 2015/133310 | A1 | 9/2015 |

OTHER PUBLICATIONS

Written Opinion Issued in PCT/JP2018/032853 dated Dec. 11, 2018.
Chip Inductors for Critical Applications, Coilcraft-Critical Products & Services, May 16, 2017, pp. 1-2.
Office Action, issued by the State Intellectual Property Office of China dated May 6, 2021, in connection with Chinese Patent Application No. 201880062334.8.
Office Actions, issued by the Japanese Patent Office dated Jun. 24, 2021, in connection with Japanese Patent Application No. 2017-183405.
Office Action,issued by the State Intellectual Property Office dated Nov. 24, 2021, in connection with Chinese Patent Application No. 201880062334.8.
Xi Zhihong, Circuit Analysis, Aug. 31, 2016, p. 384.
Fan Yingxian Research on Manufacturing Process and Miniaturization of Laminated Chip Conductors, Mar. 20, 2011, pp. 1-63.
Office Action,issued by the Taiwanese Intellectual Property Office dated Sep. 12, 2022, in connection with Taiwanese Patent Application No. 107132160.
Office Action, issued by the Korean Intellectual Property Office dated Sep. 13, 2022, in connection with Korean Patent Application No. 10-2020-7008165.

* cited by examiner

INDUCTOR AND PRODUCING METHOD THEREOF

CROSS-REFERENCE TO RELATED APPLICATIONS

The present application is a 35 U.S.C. 371 National Stage Entry of PCT/JP2018/032853, filed on Sep. 5, 2018, which claims priority from Japanese Patent Application No. 2017-183405, filed on Sep. 25, 2017, the contents of all of which are herein incorporated by reference in their entirety.

TECHNICAL FIELD

The present invention relates to an inductor and a producing method thereof.

BACKGROUND ART

It has been known that an inductor is mounted on an electronic device or the like to be used as a passive element such as voltage conversion member.

For example, a laminated chip inductor has been proposed in which an inner electrode formed in a meander shape is provided in each multiple-layered board stacked in a thickness direction; an upper-side external electrode is formed in one end portion of the inner electrode in the uppermost portion, while the plurality of inner electrodes are electrically connected to each other in a via hole; and a lower-side external electrode is formed in the other end portion of the inner electrode in the lowermost portion (ref: for example, Patent Document 1).

CITATION LIST

Patent Document

Patent Document 1: Japanese Unexamined Patent Publication No. H7-86039

SUMMARY OF THE INVENTION

Problem to be Solved by the Invention

A reduction in size of the electronic device has been recently advanced, and thus, a reduction in size of the inductor to be mounted has been demanded. However, there is a disadvantage that the laminated chip inductor described in Patent Document 1 includes the multiple-layered board, so that the above-described demand cannot be satisfied.

Meanwhile, there is a disadvantage that a reduction in resistance of the inductor is demanded, and the laminated chip inductor described in Patent Document 1 cannot satisfy the above-described demand.

The present invention provides an inductor achieving a reduction in size and a reduction in resistance, and a producing method thereof.

Means for Solving the Problem

The present invention (1) includes an inductor including a wire having a width W, and a first electrode and a second electrode continuous to each of both ends of the wire, wherein the wire, the first electrode, and the second electrode are present on the same plane; the plane area S1 of the first electrode and the plane area S2 of the second electrode are a square value ($W^2$) or more of the width W; an area in which the wire is disposed is positioned between the first electrode and the second electrode; the area has a length X in a longitudinal direction equal to a length L between the first electrode and the second electrode along a facing direction of the first electrode and the second electrode, and a length Y in a short-length direction in a direction perpendicular to the longitudinal direction; and the length X in the longitudinal direction is 1.5 times or more of the length Y in the short-length direction.

In the inductor, the wire, the first electrode, and the second electrode are present on the same plane, so that a reduction in size thereof in the thickness direction can be achieved. Also, the length X in the longitudinal direction of the area is 1.5 times or more of the length Y in the short-length direction thereof, so that a furthermore reduction in size in the short-length direction of the area can be achieved. As a result, a reduction in size of the inductor can be achieved.

In the inductor, the plane area S1 of the first electrode and the plane area S2 of the second electrode are the square value ($W^2$) or more of the width W of the wire, so that a reduction in resistance of the inductor can be achieved.

As a result, in the inductor, both of a reduction in size and a reduction in resistance can be achieved.

The present invention (2) includes the inductor described in (1) further including a magnetic layer covering a one-side surface in a thickness direction of the wire.

The inductor further includes the magnetic layer covering the one-side surface in the thickness direction of the wire, so that high inductance can be ensured.

The present invention (3) includes the inductor described in (2), wherein the magnetic layer has a thickness of 500 μm or less.

In the inductor, the magnetic layer has a thickness of 500 μm or less. Thus, a reduction in size of the inductor can be achieved, while the high inductance of the inductor is ensured.

The present invention (4) includes the inductor described in (2) or (3) further including a first bump disposed on a one-side surface in the thickness direction of the first electrode and a second bump disposed on a one-side surface in the thickness direction of the second electrode.

The inductor includes the first bump and the second bump, so that an electronic device on which the inductor is mounted can be easily electrically connected to the first electrode and the second electrode.

The present invention (5) includes the inductor described in (4), wherein a ratio of the plane area BS1 of the first bump to the plane area S1 of the first electrode is 70% or more, and a ratio of the plane area BS2 of the second bump to the plane area S2 of the second electrode is 70% or more.

In the inductor, the ratio of the plane area BS1 of the first bump to the plane area S1 of the first electrode is 70% or more, and the ratio of the plane area BS2 of the second bump to the plane area S2 of the second electrode is 70% or more, so that a reduction in resistance of the inductor is achieved, and a reduction in electrical connection reliability of the electronic device with the first electrode and a reduction in electrical connection reliability of the electronic device with the second electrode can be suppressed.

The present invention (6) includes the inductor described in (4) or (5), wherein a length in the thickness direction of the first bump and the second bump is longer than a thickness of the magnetic layer.

In the inductor, the length in the thickness direction of the first bump and the second bump is longer than the thickness of the magnetic layer, so that the electrical connection reliability of the electronic device with the first electrode and the second electrode can be improved.

The present invention (7) includes the inductor described in any one of (4) to (6), wherein the first bump and the second bump are disposed with a gap of 0.1 μm or more to the magnetic layer in a plane direction.

In the inductor, the first bump and the second bump are disposed with a gap of 0.1 μm or more to the magnetic layer in the plane direction, so that a short circuit of the first bump and the second bump with the magnetic layer can be effectively prevented. Thus, the electrical connection reliability of the electronic device with the first electrode and the second electrode can be improved.

The present invention (8) includes the inductor described in any one of (4) to (7) further including a cover insulating layer covering the surroundings of the first bump and the second bump and disposed at one side in the thickness direction of the wire, the first electrode, and the second electrode.

The inductor includes the cover insulating layer, so that the cover insulating layer can cover (protect) the first electrode, the second electrode, and the wire, and thus, the electrical connection reliability can be improved.

The present invention (9) includes the inductor described in any one of (1) to (8) further including a base insulating layer disposed on an other-side surface in the thickness direction of the wire and a second magnetic layer disposed on an other-side surface in the thickness direction of the base insulating layer.

The inductor further includes the second magnetic layer, so that the high inductance can be ensured.

The present invention (10) includes a method for producing an inductor for producing the inductor described in any one of (2) to (9) including the steps of producing a plurality of units each including one wire, one first electrode, and one second electrode along one direction in a plane direction; disposing a long-length magnetic sheet being long in the one direction with respect to the plurality of units so as to collectively cover one-side surfaces in a thickness direction of the plurality of wires in the plurality of units to form magnetic layers from the magnetic sheet; and cutting the magnetic layers along a direction crossing the one direction to singulate the plurality of units.

In the producing method, the long-length magnetic sheet that is long in the one direction is disposed with respect to the plurality of units so as to collectively cover the one-side surfaces in the thickness direction of the plurality of wires in the plurality of units, and the units are singulated to form the magnetic layers from the magnetic sheet, so that the plurality of inductors can be efficiently produced.

Effect of the Invention

In the inductor of the present invention, both of a reduction in size and a reduction in resistance are achieved.

In the method for producing an inductor of the present invention, the plurality of inductors can be efficiently produced.

BRIEF DESCRIPTION OF THE DRAWINGS

FIG. 1A illustrating a plan view in which a cover insulating layer is omitted and FIG. 1B illustrating a plan view in which a first bump, a second bump, and the cover insulating layer are omitted.

FIG. 3A illustrating a step of preparing a base insulating layer and a conductive layer, FIG. 3B illustrating a step of providing a wire, a first electrode, and a second electrode, FIG. 3C illustrating a step of providing a magnetic layer and a second magnetic layer, FIG. 3D illustrating a step of providing the first bump and the second bump, and FIG. 3E illustrating a step of providing the cover insulating layer.

FIG. 4A illustrating a step of preparing a base insulating layer and a conductive layer, FIG. 4B illustrating a step of providing a wire, a first electrode, and a second electrode, FIG. 4C illustrating a step of providing a magnetic layer and a second magnetic layer, and FIG. 4D illustrating a step of providing the first bump, the second bump, and the cover insulating layer and a step of singulating inductor assemblies.

DESCRIPTION OF EMBODIMENTS

First Embodiment

A first embodiment of an inductor of the present invention is described with reference to FIGS. 1A to 2.

Figure 1A:
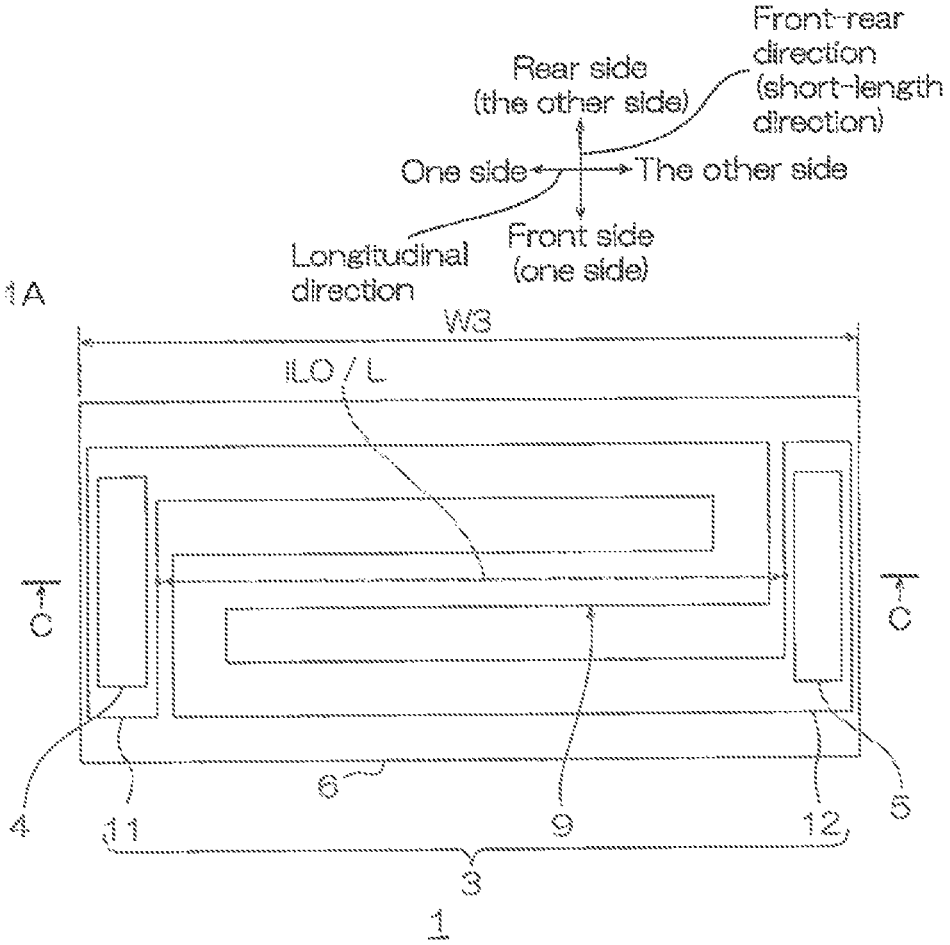
FIGS. 1A and 1B show a one embodiment of an inductor of the present invention.
Figure 1B:
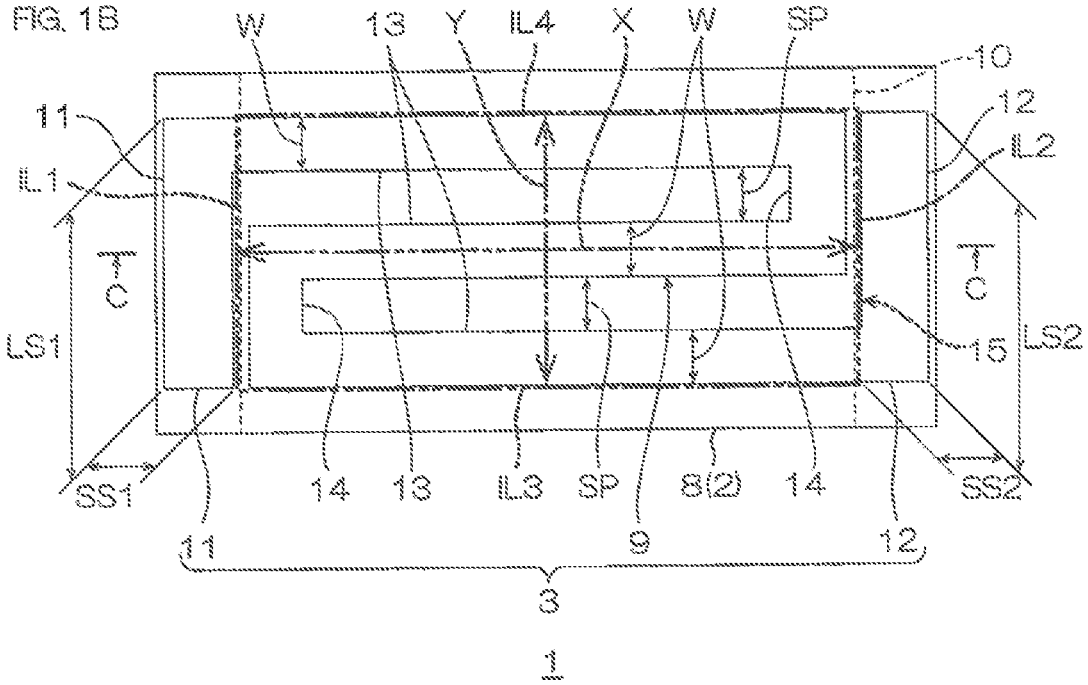

In FIGS. 1A and 1B, the right-left direction on the plane of the sheet is a longitudinal direction of the inductor, the left side on the plane of the sheet is one side in the longitudinal direction, and the right side on the plane of the sheet is the other side in the longitudinal direction.

In FIGS. 1A and 1B, the up-down direction on the plane of the sheet is a front-rear direction (short-length direction of the inductor), the lower side on the plane of the sheet is a front side (one side in the short-length direction), and the upper side on the plane of the sheet is a rear side (the other side in the short-length direction).

In FIGS. 1A and 1B, the paper thickness direction on the plane of the sheet is a thickness direction of the inductor, the near side on the plane of the sheet is an upper side (one side in the thickness direction), and the far side on the plane of the sheet is a lower side (the other side in the thickness direction).

In the plan view of FIG. 1A, a cover insulating layer 6 (described later) is omitted so as to clearly show the relative arrangement of a first electrode 11, a second electrode 12, and a wire 9 (a wire area 15) (described later) when viewed from the top (same as when projected in the thickness direction).

In the plan view of FIG. 1B, a first bump 4, a second bump 5, and the cover insulating layer 6 (described later) are omitted, and a magnetic layer 10 (described later) is shown by a dashed line so as to clearly show the relative arrangement of the first electrode 11, the second electrode 12, and the wire 9 (the wire area 15) (described later) when viewed from the top (same as when projected in the thickness direction).

An inductor 1 has a generally rectangular sheet shape extending in the longitudinal direction. The inductor 1 includes a base layer 2, a conductive layer 3, the first bump 4, the second bump 5, the magnetic layer 10, and the cover insulating layer 6.

The base layer 2 has a sheet shape having the same outer shape as that of the inductor 1. The base layer 2 sequentially includes a second magnetic layer 7 and a base insulating layer 8 upwardly in the thickness direction.

The second magnetic layer 7 is a layer that imparts high inductance to the inductor 1. The second magnetic layer 7 has a sheet shape having the flat upper surface and the flat lower surface along the longitudinal direction and the front-rear direction. The second magnetic layer 7 is the lowermost layer of the inductor 1. The second magnetic layer 7 is also the lower layer of the base layer 2. Examples of a material for the second magnetic layer 7 include magnetic compositions (to be specific, curable magnetic compositions) disclosed in Japanese Unexamined Patent Publication No. 2014-189015 or the like. The second magnetic layer 7 has a thickness of, for example, 10 μm or more, preferably 50 μm or more, and for example, 500 μm or less, preferably 300 μm or less.

The base insulating layer 8 is disposed on the entire upper surface of the second magnetic layer 7. The base insulating layer 8 is the upper layer of the base layer 2. The base insulating layer 8 has the flat upper surface and the flat lower surface along the longitudinal direction and the front-rear direction. The upper surface of the base insulating layer 8 forms the upper surface of the base layer 2. The upper surface of the base insulating layer 8 is also a flat surface for disposing the conductive pattern 3 to be described next on the same plane. Examples of a material for the base insulating layer 8 include insulating materials such as inorganic materials including glass and ceramics, organic materials including polyimide and fluorine resin, and composite materials thereof (glass epoxy). The base insulating layer 8 has a thickness of, for example, 0.1 μm or more, preferably 0.5 μm or more, and for example, 15 μm or less, preferably 10 μm or less.

A thickness of the base layer 2 is a total sum of the thickness of the second magnetic layer 7 and that of the base insulating layer 8, and for example, 10.1 μm or more, preferably 50.5 μm or more, and for example, 515 μm or less, preferably 310 μm or less.

The conductive pattern 3 is disposed on the upper surface of the base layer 2. The conductive pattern 3 is an electrode pattern continuously including the first electrode 11, the second electrode 12, and the wire 9.

The first electrode 11 is disposed on the upper surface of the base insulating layer 8. To be specific, the first electrode 11 is positioned in one end portion (left end portion in FIGS. 1A and 1B) in the longitudinal direction on the upper surface of the base insulating layer 8. The first electrode 11 is also one end portion in the longitudinal direction of the conductive pattern 3. The first electrode 11 has a generally rectangular shape when viewed from the top extending in the short-length direction (front-rear direction).

The second electrode 12 is disposed on the upper surface of the base insulating layer 8. To be specific, the second electrode 12 is disposed in opposed relation to the first electrode 11 at the other side in the longitudinal direction (right side in FIGS. 1A and 1B) at spaced intervals thereto on the upper surface of the base insulating layer 8. To be more specific, the second electrode 12 is positioned in the other end portion (right end portion in FIGS. 1A and 1B) in the longitudinal direction on the upper surface of the base insulating layer 8. The second electrode 12 is the other end portion in the longitudinal direction of the conductive pattern 3. The second electrode 12 has the same shape as the first electrode 11. That is, the second electrode 12 has a generally rectangular shape when viewed from the top extending in the short-length direction (front-rear direction). The first electrode 11 and the second electrode 12 form a pair of electrodes.

A facing direction of the first electrode 11 and the second electrode 12 is a direction (the shortest direction) along a phantom shortest line segment IL0 (ref: FIG. 1A) that connects the first electrode 11 to the second electrode 12 in the shortest distance. The shortest direction is the same as the longitudinal direction of the inductor 1. A length of the phantom shortest line segment IL0 is the shortest distance (a length L) between the first electrode 11 and the second electrode 12.

The wire 9 is disposed in the wire area 15 as one example of an area.

The wire area 15 is an area positioned between the first electrode 11 and the second electrode 12. To be specific, the wire area 15 has a length X in the longitudinal direction that is equal to the length L between the first electrode 11 and the second electrode 12 along the longitudinal direction in the inductor 1, and a length Y in the front-rear direction as one example of a length in the short-length direction in a direction perpendicular to the longitudinal direction. The details of the "length L between the first electrode 11 and the second electrode 12" are described later.

In the longitudinal direction of the inductor 1, the wire area 15 is an area between a first phantom line segment IL1 along the other end edge (right end edge, end edge at the side closer to the second electrode 12) in the longitudinal direction of the first electrode 11 and a second phantom line segment IL2 along one end edge (left end edge, end edge at the side closer to the first electrode 11) in the longitudinal direction of the second electrode 12; and also an area between a third phantom line segment IL3 along the front end edge of the wire 9 and a fourth phantom line segment IL4 along the rear end edge of the wire 9. In the one embodiment, the third phantom line segment IL3 is along the front end edges of each of the first electrode 11 and the second electrode 12, and the fourth phantom line segment IL4 is along the rear end edges of each of the first electrode 11 and the second electrode 12. The first phantom line segment IL1 and the second phantom line segment IL2 are parallel with each other, and the third phantom line segment IL3 and the fourth phantom line segment IL4 are parallel with each other. The area in a generally rectangular shape when viewed from the top defined by the first phantom line segment ILL the second phantom line segment IL2, the third phantom line segment IL3, and the fourth phantom line segment IL4 is the wire area 15. Then, the plane area of the wire area 15 is represented by the product (XY) of the length X in the longitudinal direction and the length Y in the front-rear direction of the wire area 15.

The wire 9 is disposed at the inside of the wire area 15 so as to be continuous to the first electrode 11 and the second electrode 12. The wire 9 has a width W and has a generally meandering shape when viewed from the top at the inside of the wire area 15. Both end portions of the wire 9 are continuous to each of the first electrode 11 and the second electrode 12. To be specific, the wire 9 continuously has a plurality of straight line portions 13 and a plurality of connecting portions 14 that connect one end portions to each other or connect both end portions to each other in the longitudinal direction of the two straight line portions 13 that are next to each other. The plurality of straight line portions 13 are disposed at spaced intervals to each other in the front-rear direction. Each of the plurality of straight line portions 13 has a shape extending along the longitudinal direction. Of the plurality of straight line portions 13, for example, the straight line portion 13 positioned in the rear end portion is continuous to the rear end portion of the first electrode 11, and the straight line portion 13 positioned in the front end portion is continuous to the front end portion of the second electrode 12. Each of the plurality of connecting portions 14 is shorter than each of the plurality of straight line portions 13. The plurality of connecting portions 14 are alternately disposed near the first electrode 11 and near the second electrode 12 at the inside of the wire area 15.

The first electrode 11, the second electrode 12, and the wire 9 are present on the same plane. The first electrode 11, the second electrode 12, and the wire 9 are overlapped with each other, to be more specific, coincide with each other when projected in the longitudinal direction. As clear in FIG. 2, also in the above-described projection, the upper surfaces and the lower surfaces of the first electrode 11, the second electrode 12, and the wire 9 are overlapped with each other, to be more specific, coincide with each other.

The wire 9, the first electrode 11, and the second electrode 12 in the conductive pattern 3 are made of the same material. Examples of a material for the conductive pattern 3 include conductors disclosed in Japanese Unexamined Patent Publication No. 2014-189015. Preferably, a metal such as copper is used.

The conductive pattern 3 has a thickness of, for example, 5 μm or more, preferably 10 μm or more, and for example, 300 μm or less, preferably 100 μm or less.

The details of a size or the like of the conductive pattern 3 when viewed from the top are described later.

The first bump 4 is a contact point used for electrical connection of the first electrode 11 to a connecting member 21 (described later, ref: phantom line of FIG. 2). The first bump 4 is disposed on the upper surface of the first electrode 11. To be specific, the first bump 4 has a generally rectangular box (plate) shape extending in the front-rear direction and the thickness direction. The first bump 4 has a generally similar shape to the first electrode 11. The upper surface of the first bump 4 is exposed upwardly, while the lower surface of the first bump 4 is in contact with the central portion of the upper surface of the first electrode 11. The peripheral end portion of the first electrode 11 is exposed from the first bump 4. The side surfaces (both side surfaces in the longitudinal direction and both surfaces in the front-rear direction) of the first bump 4 are covered with the cover insulating layer 6 to be described later. The first bump 4 is in contact with the upper surface of the first electrode 11, so that it is also a first electrode post. As a material for the first bump 4, the above-described conductor (including solder) is used.

A ratio (BS1/S1) of the plane area BS1 of the first bump 4 to the plane area S1 (described later) of the first electrode 11 is, for example, 70% or more, preferably 80% or more, more preferably 90% or more, and for example, 100% or less. When BS1/S1 is the above-described lower limit or more, a reduction in resistance of the first bump 4 and the first electrode 11 is achieved, and a reduction in electrical connection reliability of an electronic device (not shown) with the first electrode 11 can be suppressed.

The second bump 5 is a contact point used for electrical connection of the second electrode 12 to the connecting member 21 (described later, ref: phantom line of FIG. 2). The second bump 5 is disposed on the upper surface of the second electrode 12. To be specific, the second bump 5 has a generally rectangular box (plate) shape extending in the front-rear direction and the thickness direction. The second bump 5 has a generally similar shape to the second electrode 12. The upper surface of the second bump 5 is exposed upwardly, while the lower surface of the second bump 5 is in contact with the central portion of the upper surface of the second electrode 12. The peripheral end portion of the second electrode 12 is exposed from the second bump 5. The side surfaces (both side surfaces in the longitudinal direction and both surfaces in the front-rear direction) of the second bump 5 are covered with the cover insulating layer 6 to be described later. The second bump 5 is in contact with the upper surface of the second electrode 12, so that it is also a second electrode post. A material for the second bump 5 is the same as that for the first bump 4.

A ratio (BS2/S2) of the plane area BS2 of the second bump 5 to the plane area S2 (described later) of the second electrode 12 is, for example, 70% or more, preferably 80% or more, more preferably 90% or more, and for example, 100% or less. When BS2/S2 is the above-described lower limit or more, a reduction in resistance of the second bump 5 and the second electrode 12 is achieved, and a reduction in electrical connection reliability of the electronic device (not shown) with the second electrode 12 can be suppressed.

A thickness T1 of the first bump 4 is the same as the thickness T1 of the second bump 5 and is, for example, 15 μm or more, preferably 50 μm or more, and for example, 600 μm or less, preferably 500 μm or less. The thickness T1 of the first bump 4 is a distance between the upper surface of the first electrode 11 (the conductive pattern 3) and the upper surface of the first bump 4. The thickness T1 of the second bump 5 is a distance between the upper surface of the second electrode 12 (the conductive pattern 3) and the upper surface of the second bump 5.

The magnetic layer 10 is a layer that imparts high inductance to the inductor 1. The magnetic layer 10 has a generally sheet shape extending in the longitudinal direction and the short-length direction of the inductor 1. The magnetic layer 10 covers the wire 9 on the base insulating layer 8. Thus, the magnetic layer 10 includes the lower surface corresponding to the shape of the wire 9, and the flat upper surface facing the lower surface at the upper side thereof. Meanwhile, in the longitudinal direction of the inductor 1, the magnetic layer 10 is positioned at the inside of the first electrode 11 and the second electrode 12 with a gap therebetween, and does not cover the first electrode 11 and the second electrode 12.

That is, one end edge in the longitudinal direction of the magnetic layer 10 is positioned at the other side in the longitudinal direction with respect to the other end edge in the longitudinal direction of the first bump 4 with a minute gap therebetween, and the other end edge in the longitudinal direction of the magnetic layer 10 is positioned at one side in the longitudinal direction with respect to one end edge in the longitudinal direction of the second bump 5 with a minute gap therebetween. To be specific, the magnetic layer 10 is spaced apart from the first bump 4 and the second bump 5 with a gap IN of, for example, 0.1 μm or more, preferably 0.3 μm or more, more preferably 0.5 μm or more and, for example, 10 μm or less in the longitudinal direction.

When the above-described gap IN is the above-described lower limit or more, a short circuit of the first bump 4 and the second bump 5 with the magnetic layer 10 can be effectively prevented.

Both end edges in the front-rear direction of the magnetic layer 10 coincide with both end edges in the front-rear direction of the base layer 2 when projected in the thickness direction.

A thickness T2 of the magnetic layer 10 is, for example, shorter than the thickness T1 of the first bump 4 and the second bump 5. In other words, the thickness T1 of the first bump 4 and the second bump 5 is longer than the thickness T2 of the magnetic layer 10.

To be specific, the thickness T2 of the magnetic layer 10 with respect to the thickness T1 of the first bump 4 and the second bump 5 is, for example, 99% or less, preferably 97% or less, more preferably 95% or less, and for example, 70% or more.

To be more specific, the magnetic layer 10 has the thickness T2 of, for example, 500 μm or less, preferably 300 μm or less, more preferably 100 μm or less, and for example, 10 μm or more. When the thickness T2 of the magnetic layer 10 is the above-described upper limit or less, a reduction in size of the inductor 1 can be achieved.

The thickness T2 of the magnetic layer 10 is a distance between the upper surface of the wire 9 (the conductive pattern 3) and the upper surface of the magnetic layer 10.

When the thickness T1 of the first bump 4 and the second bump 5 is longer than the thickness T2 of the magnetic layer 10, in a case where the connecting member 21 (described later) is brought into contact with the upper surfaces of the first bump 4 and the second bump 5, the connecting member 21 is not easily brought into contact with the magnetic layer 10, and thus, the electrical connection reliability of the electronic element (not shown) with the first electrode 11 and the second electrode 12 can be improved.

A material for the magnetic layer 10 is the same as that for the second magnetic layer 7.

The cover insulating layer 6 is a protective insulating layer that protects the first electrode 11, the second electrode 12, and the wire 9. On the base insulating layer 8, the cover insulating layer 6 covers the surroundings of the first electrode 11, the first bump 4, the second electrode 12, and the second bump 5, and covers the entire magnetic layer 10. To be specific, the cover insulating layer 6 covers the side surfaces of the first bump 4, the side surfaces of the second bump 5, the peripheral end portion on the upper surface and the side surfaces of the first electrode 11, and the peripheral end portion on the upper surface and the side surfaces of the second electrode 12. Also, the cover insulating layer 6 covers the side surfaces and the upper surface of the magnetic layer 10. Furthermore, the cover insulating layer 6 covers a portion other than the portion in which the first electrode 11, the second electrode 12, and the magnetic layer 10 are formed on the upper surface of the base insulating layer 8. Thus, the cover insulating layer 6 has the lower surface corresponding to the first electrode 11, the second electrode 12, and the magnetic layer 10 and the flat upper surface facing the lower surface at the upper side thereof. The upper surface of the cover insulating layer 6 is flush with the upper surfaces of the first bump 4 and the second bump 5. That is, the upper surface of the cover insulating layer 6, and the upper surfaces of the first bump 4 and the second bump 5 form the one flat surface. The peripheral end edge of the cover insulating layer 6 coincides with that of the base layer 2 when projected in the thickness direction.

A material for the cover insulating layer 6 is the same as that for the base insulating layer 8. The cover insulating layer 6 has a thickness of, for example, 120 μm or less, preferably 100 μm or less, and for example, 0.1 μm or more, preferably 0.3 μm or more.

Next, the details of the relationship of the length L between the first electrode 11 and the second electrode 12 with the length X in the longitudinal direction of the wire area 15 are described by contrast with Comparative Example 1 beyond the scope of the present invention.

As shown in FIGS. 1A and 1B, in the one embodiment, the length L between the first electrode 11 and the second electrode 12 is equal to the length X in the longitudinal direction of the wire area 15.

Figure 5:
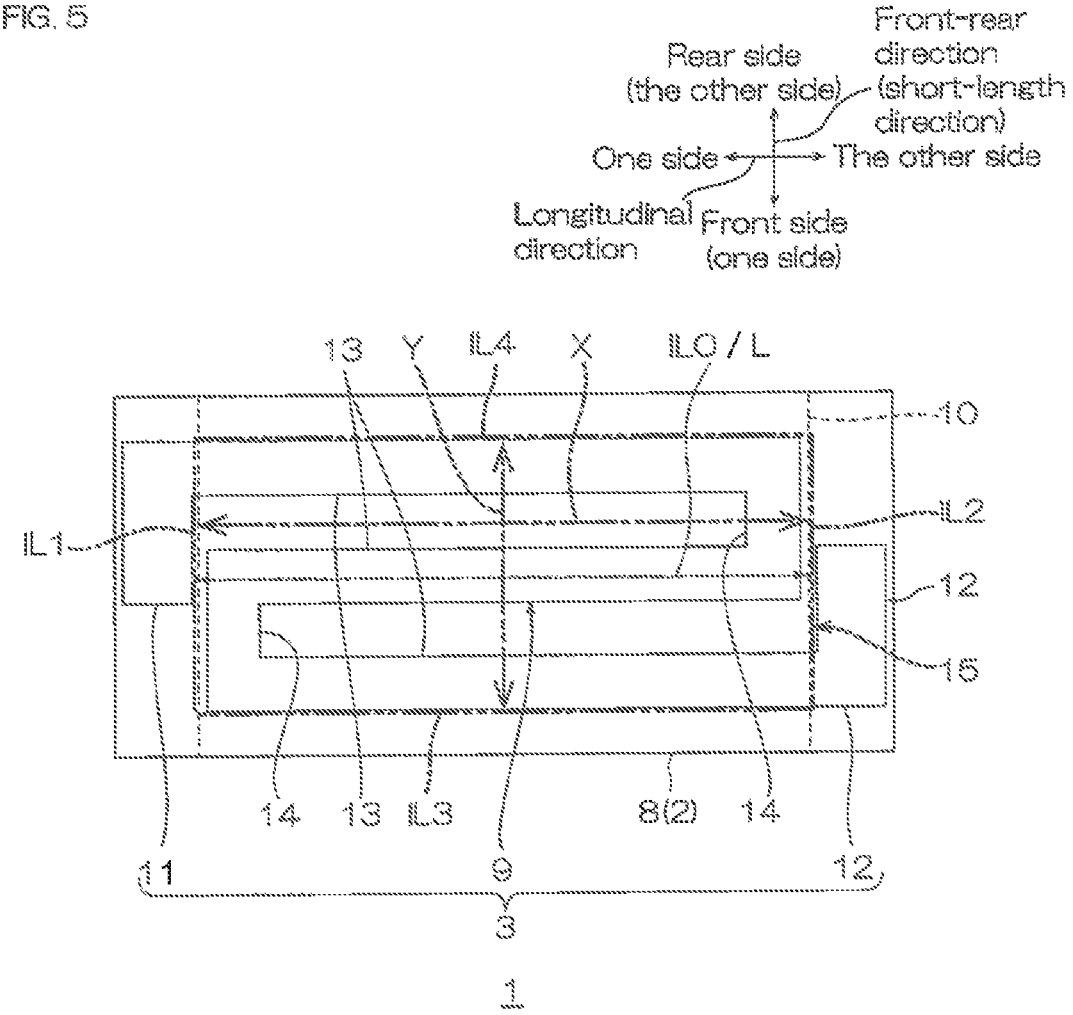
FIG. 5 shows a plan view of a first modified example of the inductor shown in FIG. 1B.

As shown in FIG. 5, in a first modified example within the scope of the present invention, as the details are described later, when the first electrode 11 and the second electrode 12 are projected in the longitudinal direction, a portion thereof is overlapped, and the length L between the first electrode 11 and the second electrode 12 that is the length of the phantom shortest line segment IL0 connecting the first electrode 11 to the second electrode 12 in the shortest distance is equal to the length X in the longitudinal direction of the wire area 15.

Figure 15:
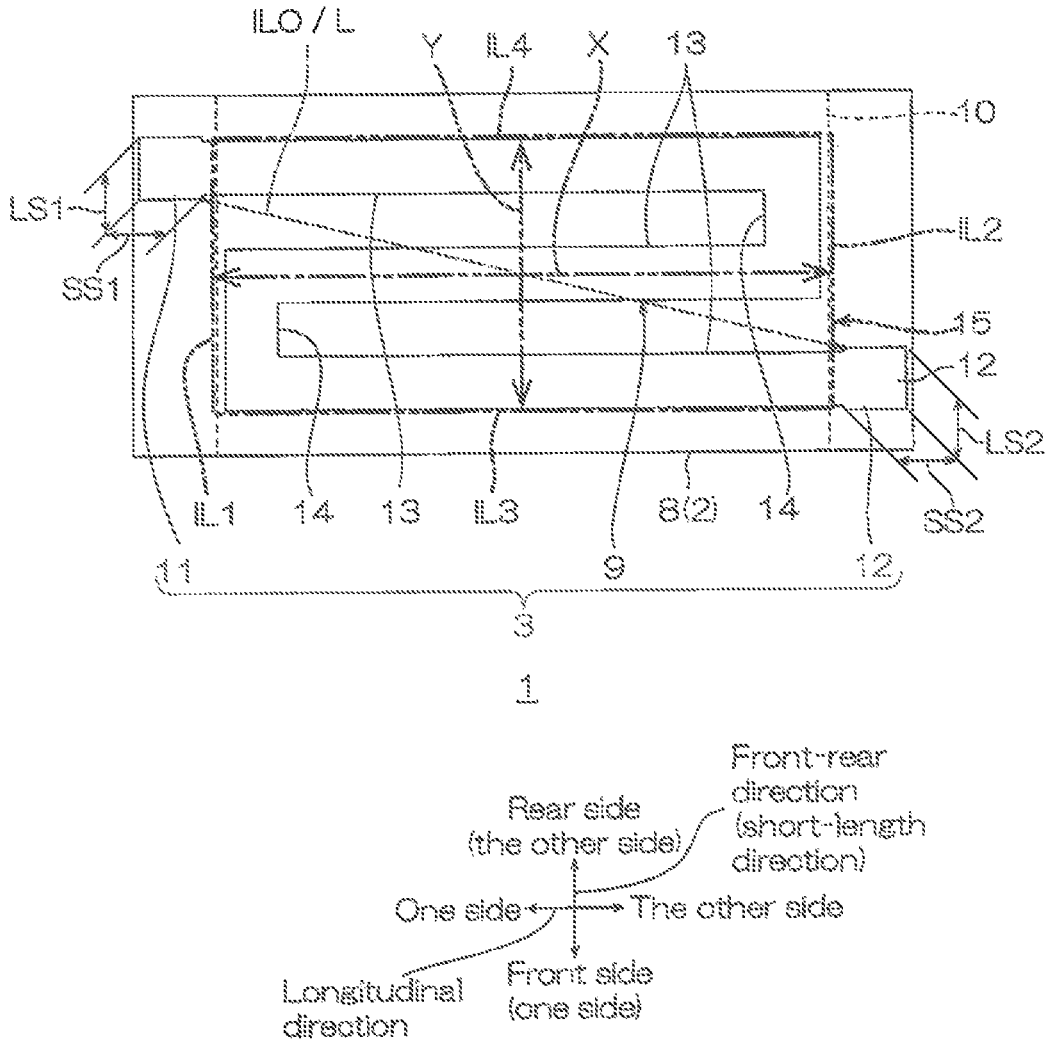
FIG. 15 shows a plan view of an inductor of Comparative Example 1, and a plan view in which a first bump, a second bump, and a cover insulating layer are omitted.

In contrast, as shown in FIG. 15, in Comparative Example 1, when the first electrode 11 and the second electrode 12 are projected in the longitudinal direction, they are not overlapped (out of position), and the length L between the first electrode 11 and the second electrode 12 that is the phantom shortest line segment IL0 is longer than the length X in the longitudinal direction of the wire area 15. That is, the length L between the first electrode 11 and the second electrode 12 is different from the length X in the longitudinal direction of the wire area 15. Accordingly, Comparative Example 1 is beyond the scope of the present invention.

Next, as shown in FIGS. 1A and 1B, the details of a size of the conductive pattern 3 when viewed from the top are described.

The wire 9 has the width W as an average value of, for example, 500 μm or less, preferably 100 μm or less, and for example, 10 μm or more, preferably 50 μm or more. A gap SP between the straight line portions 13 that are next to each other is the same as the above-described width W. The number of the wire 9 is not particularly limited, and for example, 1 or more, preferably 3 or more, and for example, 1000 or less, preferably 100 or less.

Each of the plane area S1 of the first electrode 11 and the plane area S2 of the second electrode 12 is the square value ($W^2$) or more of the width W of the wire 9. To be more specific, a ratio ($S1/W^2$ or $S2/W^2$) of the plane area S1 of the first electrode 11 or the plane area S2 of the second electrode 12 with respect to the square value ($W^2$) is above 1, preferably 2 or more, more preferably 3 or more, further more preferably 4 or more, particularly preferably 5 or more, and for example, 100 or less.

When the plane area S1 of the first electrode 11 and the plane area S2 of the second electrode 12 do not satisfy the square value ($W^2$) of the width W of the wire 9, a reduction in resistance of the inductor 1 cannot be achieved. In other words, when the plane area S1 of the first electrode 11 and the plane area S2 of the second electrode 12 are the square value ($W^2$) or more of the width W of the wire 9, a reduction in resistance of the inductor 1 can be achieved.

The first electrode 11 has a rectangular shape, so that the plane area S1 of the first electrode 11 is obtained from a length (short side) SS1 of the first electrode 11 in the longitudinal direction of the inductor 1 and a length (long side) LS1 of the first electrode 11 in the front-rear direction thereof. To be specific, the plane area S1 is obtained by SS1×LS1.

The second electrode 12 has a rectangular shape, so that the plane area S2 of the second electrode 12 is obtained from a length (short side) SS2 of the second electrode 12 in the longitudinal direction of the inductor 1 and a length (long side) LS2 of the second electrode 12 in the front-rear direction thereof. To be specific, the plane area S2 is obtained by SS2×LS2.

To be specific, the plane area S1 of the first electrode 11 and the plane area S2 of the second electrode 12 are, for example, 10000 $\mu m^2$ or more, preferably above 20000 $\mu m^2$, more preferably above 25000 $\mu m^2$, and for example, 100000 $\mu m^2$ or less, preferably 50000 $\mu m^2$ or less.

A ratio (LS1/W) of the long side LS1 of the first electrode 11 to the width W of the wire 9 is, for example, 1 or more, preferably 2 or more, more preferably 4 or more, and for example, 50 or less. The short side SS1 of the first electrode 11 is appropriately set corresponding to the plane area S1 and the long side LS1 described above.

A ratio (LS2/W) of the long side LS2 of the second electrode 12 to the width W of the wire 9 is the same as the above-described ratio (LS1/W). The short side SS2 of the second electrode 12 is appropriately set corresponding to the plane area S2 and the long side LS2 described above.

The length X in the longitudinal direction of the wire area 15 is 1.5 times or more of the length Y in the short-length direction. That is, the following formula (1) is satisfied.

$$X/Y \geq 1.5 \quad (1)$$

Preferably, the following formula (2) is satisfied.

$$X/Y \geq 2.0 \quad (2)$$

When X/Y is below the above-described lower limit (in formula (1), 1.5 and in formula (2), 2.0), a furthermore reduction in size of the second bump 5 in the front-rear direction cannot be achieved. In other words, when X/Y is the above-described lower limit or more, a furthermore reduction in size of the second bump 5 in the front-rear direction can be achieved, and as a result, a reduction in size of the inductor 1 can be achieved.

Next, a method for producing the inductor 1 is described with reference to FIGS. 3A to 3E, and 4A to 4D.

Figure 3A:
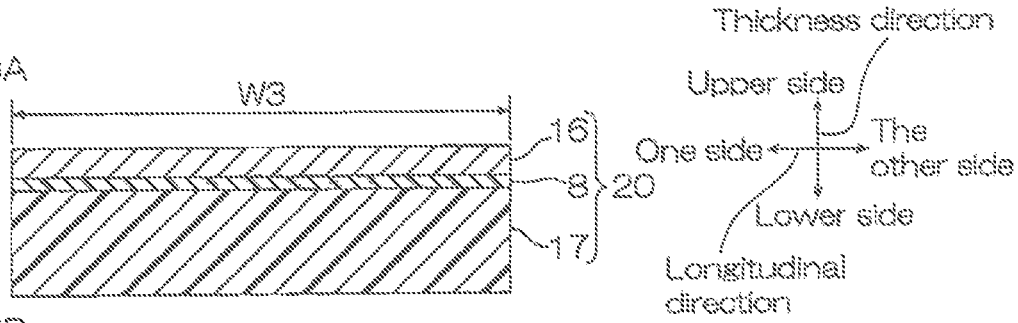
FIGS. 3A to 3E show cross-sectional views for illustrating a method for producing the inductor shown in FIG. 2.
Figure 4A:
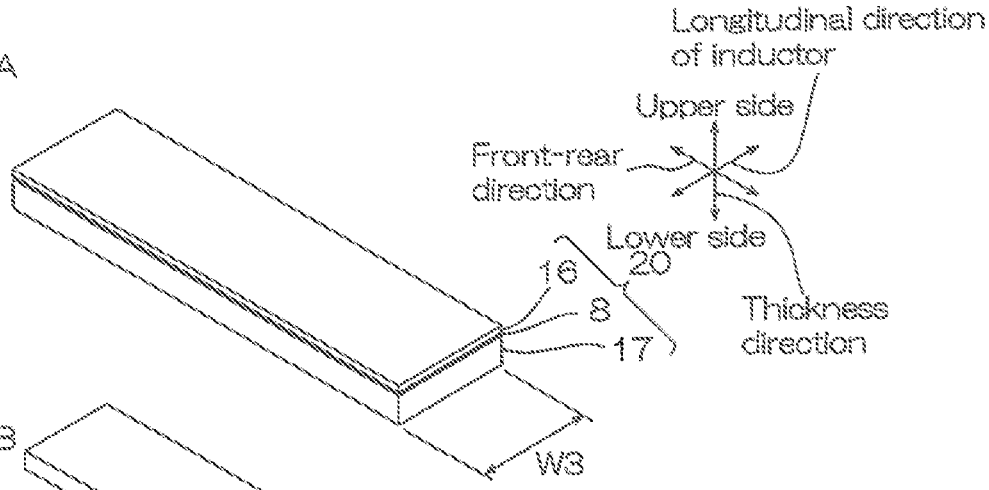
FIGS. 4A to 4D show perspective views for illustrating a method for producing the inductor shown in FIG. 2.

As shown in FIGS. 3A and 4A, in this method, first, the base insulating layer 8 and a conductive layer 16 are prepared.

The base insulating layer 8 is prepared as a long-length sheet that is long in the front-rear direction (short-length direction) of the inductor 1 to be obtained in the end. Meanwhile, the base insulating layer 8 has a width W3 that is the same length as the length in the longitudinal direction of the inductor 1.

The conductive layer 16 is a conductive sheet provided on the entire upper surface of the base insulating layer 8. A material for the conductive layer 16 is the same as that for the conductive pattern 3.

The base insulating layer 8 and the conductive layer 16 can be prepared in a state of being supported by a supporting sheet 17 from the lower side. The supporting sheet 17 is a separator made of a resin and a metal. That is, a laminate 20 sequentially including the supporting sheet 17, the second magnetic layer 7, and the conductive layer 16 upwardly in the thickness direction is prepared.

Figure 3B:
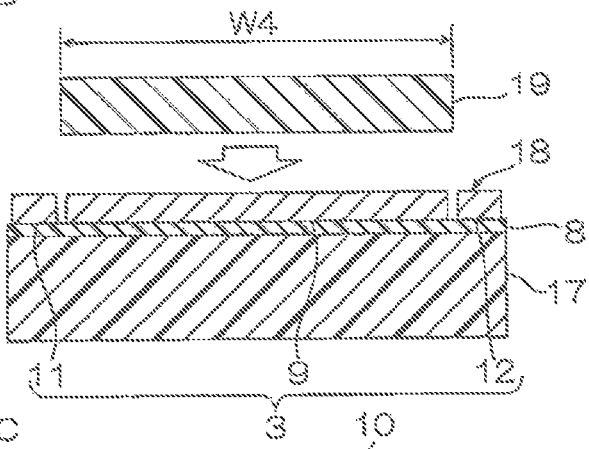
Figure 4B:
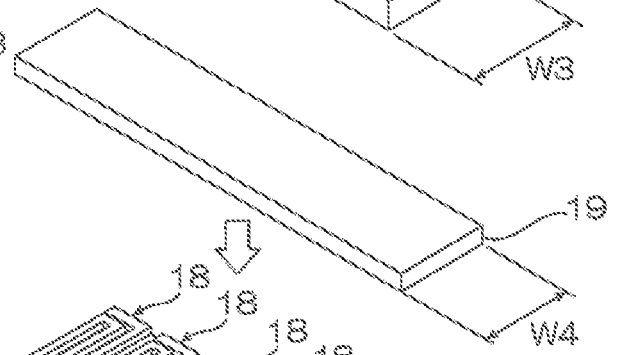

As shown in FIGS. 3B and 4B, next, the conductive pattern 3 is formed from the conductive layer 16. The conductive pattern 3 having the first electrode 11, the second electrode 12, and the wire 9 is, for example, formed by a subtractive method or the like including etching. To be specific, a plurality of units 18 each including the one first electrode 11, the one second electrode 12, and the one wire 9 are formed along the front-rear direction (long-length direction of the base insulating layer 8).

Figure 3C:
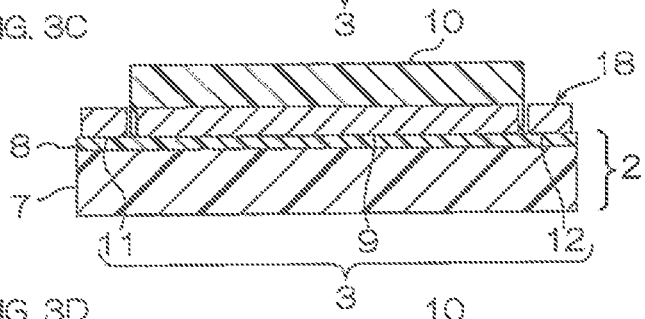
Figure 4C:
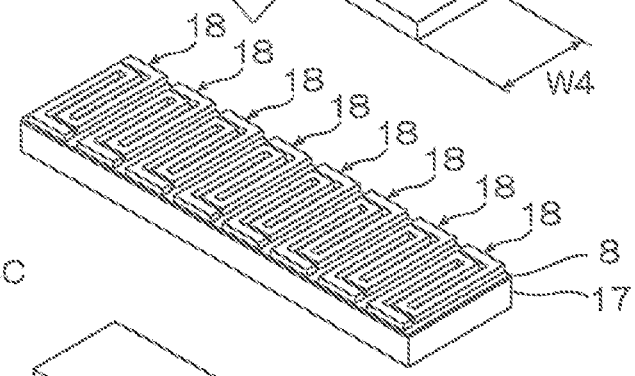
Figure 4C:
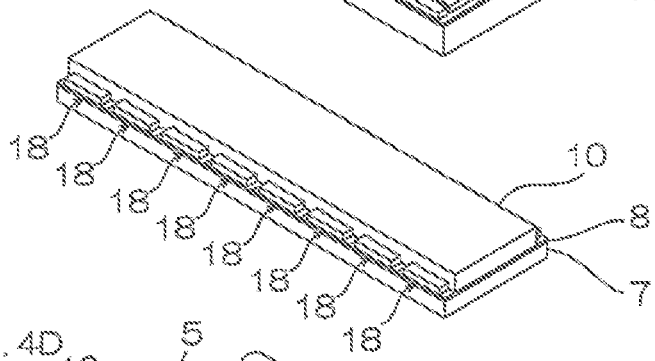

As shown in FIGS. 3C and 4C, next, the magnetic layer 10 is provided on the base insulating layer 8 so as to cover the wire 9.

To provide the magnetic layer 10, first, as shown by the upper-side view of FIG. 3B and the upper-side view of FIG. 4B, a magnetic sheet 19 having a long-length sheet shape that is long in the front-rear direction is prepared.

A width W4 of the magnetic sheet 19 is the same as the length in the longitudinal direction of the plurality of magnetic layers 10. Examples of a material for the magnetic sheet 19 include curable magnetic compositions disclosed in Japanese Unexamined Patent Publication No. 2014-189015. A thickness of the magnetic sheet 19 is appropriately set in accordance with the thickness of the magnetic layer 10 to be obtained.

Subsequently, as shown by an arrow of FIG. 3B and the arrow of FIG. 4B, the magnetic sheet 19 is disposed with respect to the plurality of units 18 so as to collectively cover the upper surfaces and the side surfaces of the plurality of wires 9 in the plurality of units 18. To be specific, the one long-length magnetic sheet 19 is pressed (pushed down) with respect to the plurality of units 18. As shown in FIGS. 3C and 4C, thereafter or simultaneously with the pressing, the magnetic sheet 19 is cured as needed, so that the magnetic layer 10 that is continuous in the front-rear direction is formed.

At the same time, the second magnetic layer 7 is provided on the lower surface of the base insulating layer 8. To provide the second magnetic layer 7, first, the supporting sheet 17 shown in FIG. 3B is peeled from the lower surface of the base insulating layer 8 (that is, the supporting sheet 17 is removed from the laminate 20) and subsequently, the second magnetic layer 7 is formed from another magnetic sheet 19.

Figure 3D:
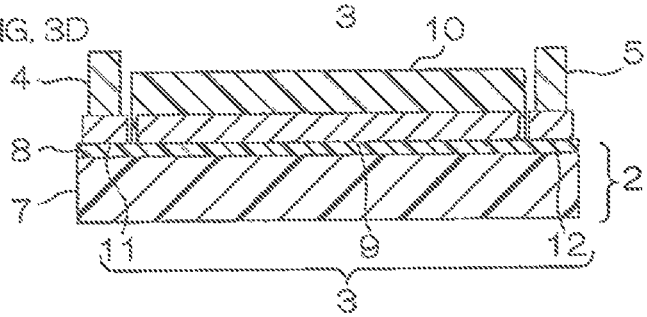
Figure 4D:
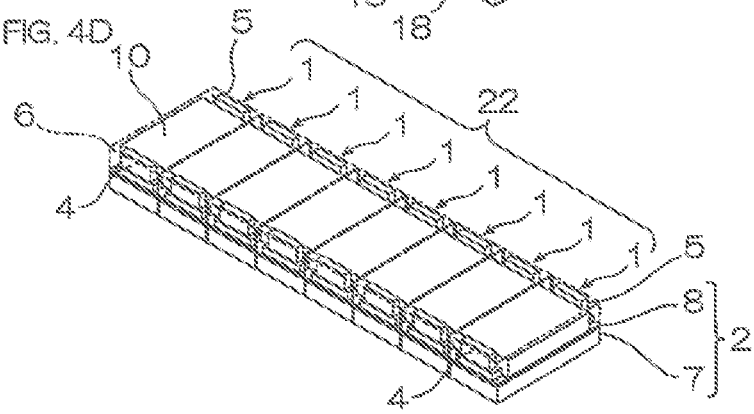

As shown in FIGS. 3D and 4D, next, the first bump 4 and the second bump 5 are provided, To be specific, the plurality of first bumps 4 and the plurality of second bumps 5 are, for example, formed on the upper surfaces of the first electrode 11 and the second electrode 12 in accordance with a pattern-forming method such as additive method and subtractive method.

Thereafter, the cover insulating layer 6 is provided in the above-described pattern.

As shown by the phantom line of FIG. 4D, in this manner, a plurality of inductor assemblies 22 including the one base layer 2, the plurality of units 18 (ref: FIG. 4C), the plurality of first bumps 4, the plurality of second bumps 5, the one magnetic layer 10, and the one cover insulating layer 6 are collectively produced.

Figure 3E:
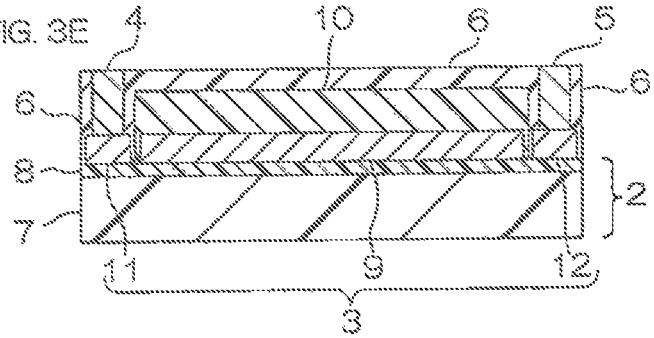

As shown by a bold phantom line of FIG. 4D, thereafter, the long-length cover insulating layer 6 (ref: FIG. 3E), the long-length magnetic layer 10, and the long-length base layer 2 (the base insulating layer 8 and the second magnetic layer 7) are cut along the thickness direction (direction perpendicular to the front-rear direction) of the inductor 1 so as to singulate the plurality of units 18, the plurality of first bumps 4, and the plurality of second bumps 5 in the inductor assemblies 22.

In this manner, the inductor 1 including the one base layer 2, the one conductive pattern 3, the one first bump 4, the one second bump 5, the one magnetic layer 10, and the one cover insulating layer 6 is produced. Preferably, the inductor 1 consists of only the base layer 2, the conductive pattern 3, the first bump 4, the second bump 5, the magnetic layer 10, and the cover insulating layer 6.

The inductor 1 is not an electronic device to be described later, and is one component of the electronic device, that is, a component for producing the electronic device. The inductor 1 does not include an electronic element (chip, capacitor, or the like) and a mounting board for mounting the electronic element, and is an industrially available device whose component alone is circulated.

The inductor 1 is, for example, to be mounted on (installed in) the electronic device or the like. Although not shown, the electronic device includes the mounting board and the electronic element (chip, capacitor, or the like) that is mounted on the mounting board. In the electronic device, the inductor 1 is mounted on the mounting board. To be specific, as shown by the phantom line of FIG. 2, the connecting member 21 such as wire and solder is in contact with the upper surfaces of the first bump 4 and the second bump 5. The inductor 1 is mounted on the mounting board via the connecting member 21 to be electrically connected to another electronic device, so that the inductor 1 functions as a passive element.

In the inductor 1, the wire 9, the first electrode 11, and the second electrode 12 are present on the same plane, so that a reduction in size thereof in the thickness direction can be achieved. Also, the length X in the longitudinal direction of the wire area 15 is 1.5 times or more of the length Y in the front-rear direction, so that a reduction in size of the wire area 15 in the front-rear direction can be achieved. As a result, a furthermore reduction in size of the inductor 1 can be achieved.

In the inductor 1, the plane area S1 of the first electrode 11 and the plane area S2 of the second electrode 12 are the square value ($W^2$) or more of the width W of the wire 9, so that a reduction in resistance of the inductor 1 can be achieved.

The inductor 1 further includes the magnetic layer 10, so that the high inductance can be ensured.

In the inductor 1, when the magnetic layer 10 has the thickness T2 of 500 μm or less, a reduction in size of the inductor 1 can be achieved, while the high inductance of the inductor 1 is ensured.

The inductor 1 includes the first bump 4 and the second bump 5, so that when the connecting member 21 is brought into contact with the upper surfaces of the first electrode 11 and the second electrode 12, the electronic device (not shown) on which the inductor 1 is mounted can be easily electrically connected to the first electrode 11 and the second electrode 12.

In the inductor 1, when the ratio of the plane area BS1 of the first bump 4 to the plane area S1 of the first electrode 11 is 70% or more, and the ratio of the plane area BS2 of the second bump 5 to the plane area S2 of the second electrode 12 is 70% or more, a reduction in resistance of the inductor 1 is achieved, and a reduction in electrical connection reliability of the electronic device (not shown) with the first electrode 11 and the second electrode 12 can be suppressed.

In the inductor 1, when the length T1 in the thickness direction of the first bump 4 and the second bump 5 is longer than the thickness T2 of the magnetic layer 10, in a case where the connecting member 21 is brought into contact with the upper surfaces of the first bump 4 and the second bump 5, the connecting member 21 does not easily get in contact with the magnetic layer 10, so that a short circuit caused by contact of the connecting member 21 with the magnetic layer 10 is suppressed, and the electrical connection reliability of the electronic device (not shown) with the first electrode 11 and the second electrode 12 can be improved.

In the inductor 1, when the first bump 4 and the second bump 5 are disposed with a gap IN of 100 μm or more to the magnetic layer 10 in the plane direction, a short circuit of the first bump 4 and the second bump 5 with the magnetic layer 10 can be effectively prevented. Thus, the electrical connection reliability of the electronic device (not shown) with the first electrode 11 and the second electrode 12 can be improved.

The inductor 1 includes the cover insulating layer 6, so that the cover insulating layer 6 can cover (protect) the first electrode 11, the second electrode 12, and the wire 9, and thus, the electrical connection reliability can be improved.

The inductor 1 further includes the second magnetic layer 7 in addition to the magnetic layer 10, so that the high inductance can be ensured.

In the method for producing the inductor 1, the long-length magnetic sheet 19 that is long in the front-rear direction is disposed with respect to the plurality of units 18 so as to collectively cover the upper surfaces of the plurality of wires 9 in the plurality of units 18, and the magnetic layers 10 are formed from the magnetic sheet 19. That is, the inductor assemblies 22 including the plurality of inductors 1 are produced. Thereafter, the inductor assemblies 22 are singulated, so that the plurality of inductors 1 are produced. As a result, the plurality of inductors 1 can be efficiently produced.

MODIFIED EXAMPLES

In each of the modified examples, the same reference numerals are provided for members and steps corresponding to each of those in the above-described one embodiment, and their detailed description is omitted. Each of the modified examples can be appropriately used in combination. Furthermore, each of the modified examples can achieve the same function and effect as that of the one embodiment unless otherwise specified.

In plan views of FIGS. 5 to 8, the first bump 4, the second bump 5, and the cover insulating layer 6 are omitted so as to clearly show the relative arrangement of the first electrode 11, the second electrode 12, and the wire 9 (the wire area 15).

First Modified Example

As shown in FIG. 5, in the inductor 1, when the first electrode 11 and the second electrode 12 are projected in the longitudinal direction, a portion thereof is overlapped. To be specific, the first electrode 11 is overlapped with the rear-side portion, and the central portion in the front-rear direction in the wire area 15 when projected in the longitudinal direction. The second electrode 12 is overlapped with the front-side portion, and the central portion in the front-rear direction in the wire area 15 when projected in the longitudinal direction. Thus, the front end portion of the first electrode 11, the rear end portion of the second electrode 12, and the central portion in the front-rear direction of the wire area 15 are overlapped when projected in the longitudinal direction.

The front end portion of the first electrode 11 faces the rear end portion of the second electrode 12 in the longitudinal direction. Thus, the phantom shortest line segment IL0 that connects the first electrode 11 to the second electrode 12 in the shortest distance is a line segment along the longitudinal direction, and the length L between the first electrode 11 and the second electrode 12 that is the length of the phantom shortest line segment IL0 is equal to the length X in the longitudinal direction of the wire area 15 in the same manner as that in the first embodiment.

Second Modified Example

Figure 6:
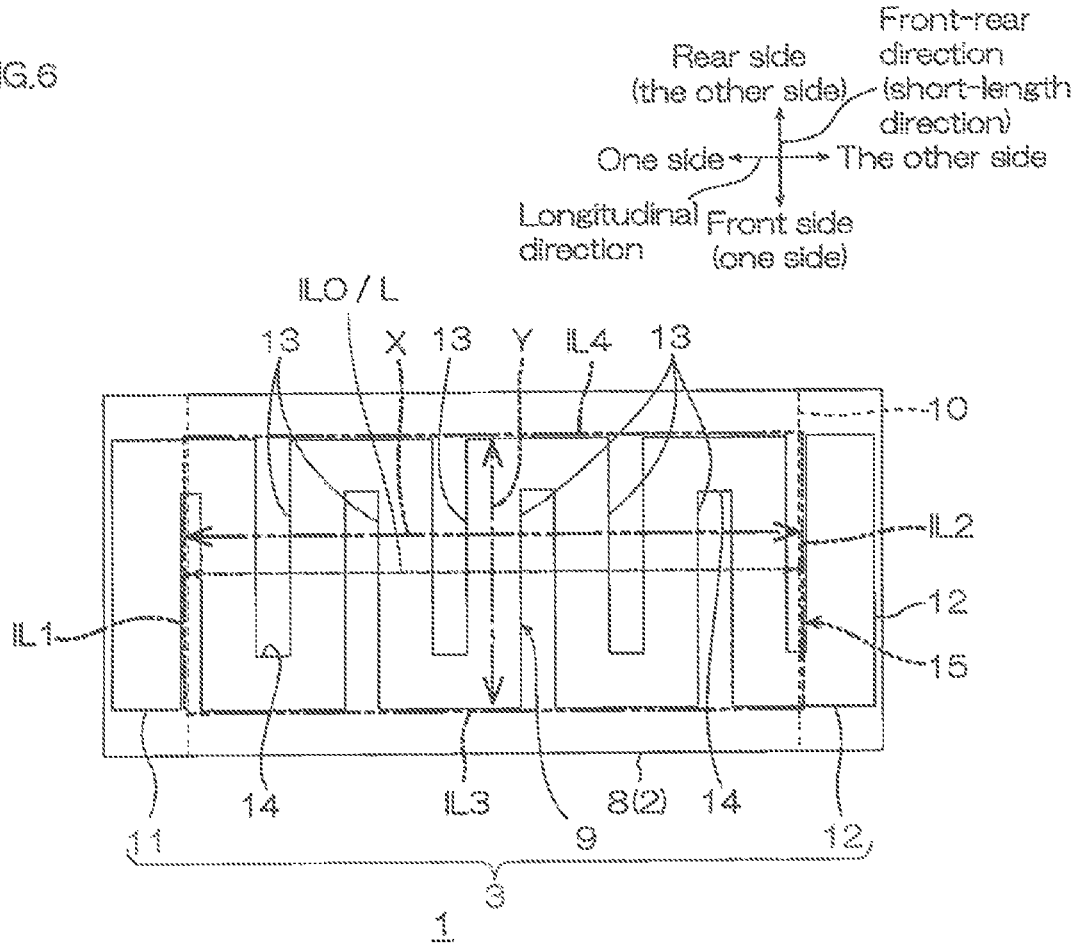
FIGS. 6 and 7 show plan views of a third modified example of the inductor shown in FIG. 1B.

The pattern shape of the wire 9 is not limited to the description above. As shown in FIG. 6, in the second modified example, the plurality of straight line portions 13 are disposed at spaced intervals to each other in the longitudinal direction. Each of the plurality of straight line portions 13 extends in the front-rear direction.

Third Modified Example

Figure 7:
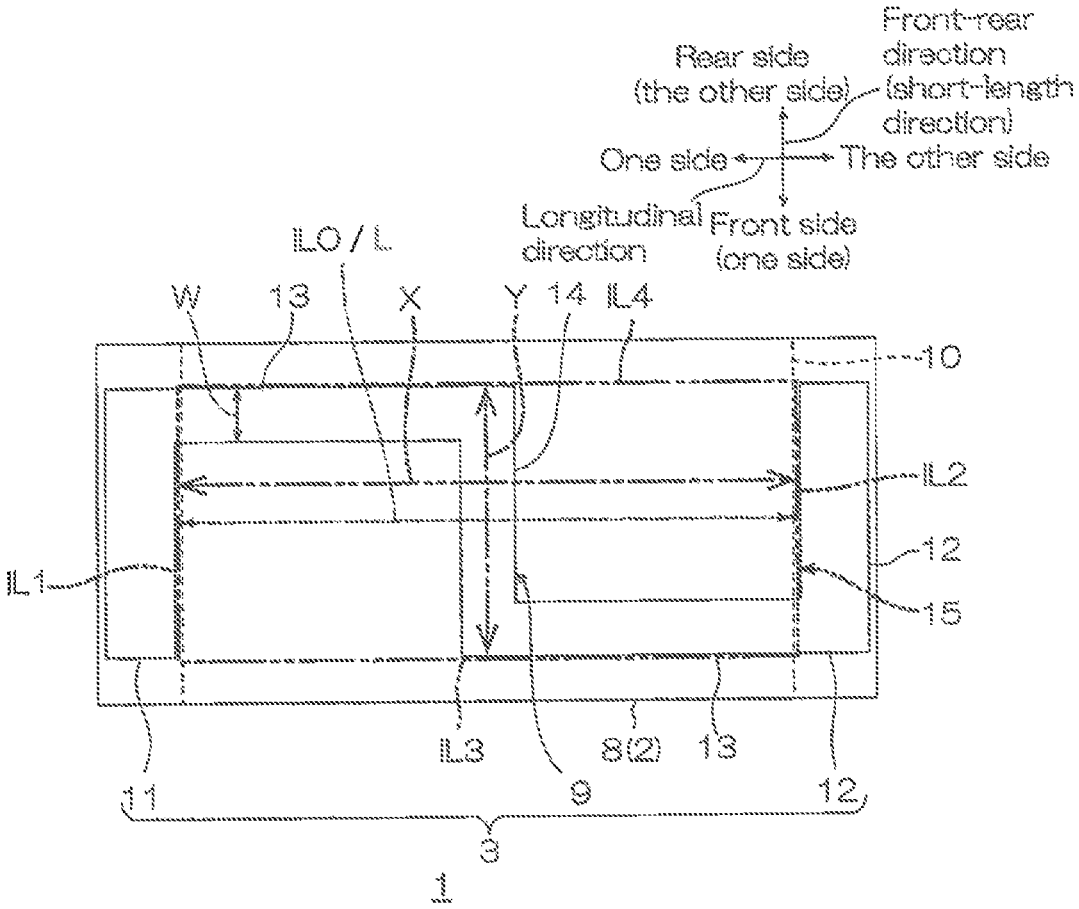

As shown in FIG. 7, in the third modified example, the wire 9 has only the one connecting portion 14. The connecting portion 14 is positioned in the central portion in the longitudinal direction, and connects one end edge in the longitudinal direction of the straight line portion 13 at the front side to the end portion in the longitudinal direction of the straight line portion 13 at the rear side in the front-rear direction. In the third modified example, the length of the connecting portion 14 may be the same as or longer than the length of the straight line portion 13.

Fourth Modified Example

Figure 8:
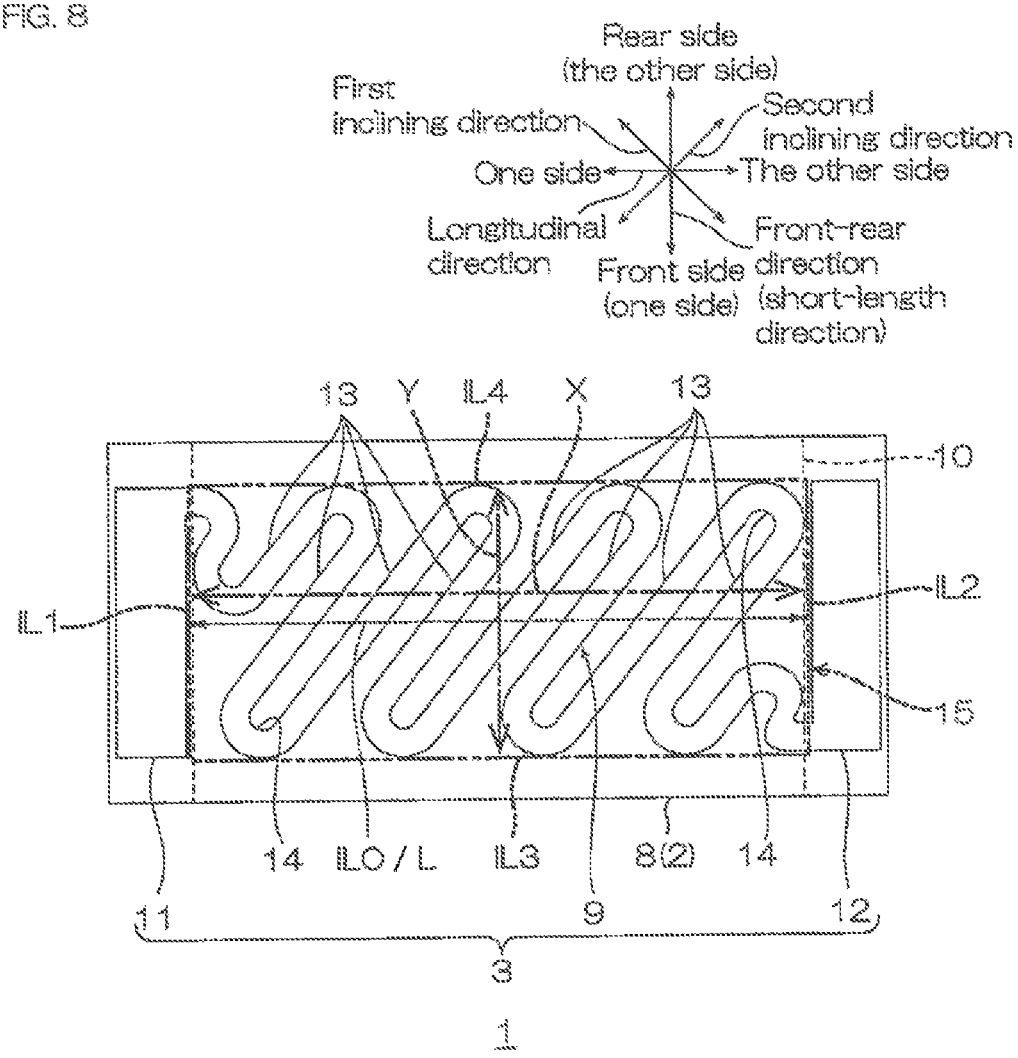
FIG. 8 shows a plan view of a fourth modified example of the inductor shown in FIG. 1B.

As shown in FIG. 8, in the fourth modified example, the plurality of straight line portions 13 are disposed at spaced intervals to each other in a first inclining direction in which the straight line portions 13 incline toward one side in the longitudinal direction as they go closer to the front side. Each of the plurality of straight line portions 13 has a shape extending along a direction perpendicular to the first inclining direction (second inclining direction in which the straight line portions 13 incline toward the other side in the longitudinal direction as they go closer to the front side).

The connecting portion 14 can, for example, have a curved shape when viewed from the top.

Fifth Modified Example

Figure 9:
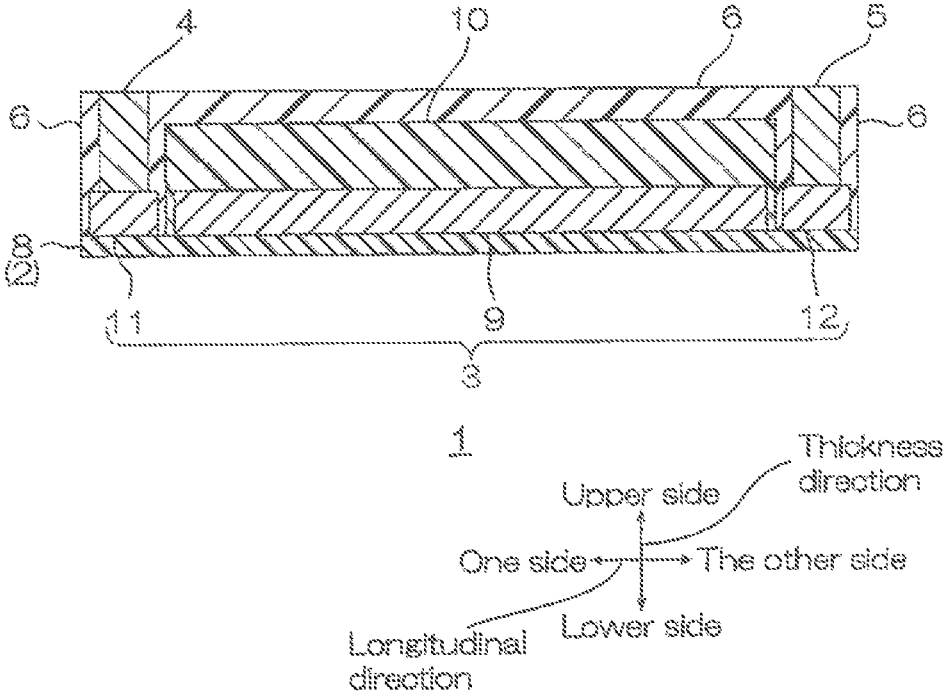
FIG. 9 shows a cross-sectional view of a fifth modified example of the inductor shown in FIG. 2.

As shown in FIG. 9, the inductor 1 does not include the second magnetic layer 7 (ref: FIG. 2). The base layer 2 does not include the second magnetic layer 7, and consists of only the base insulating layer 8. The base insulating layer 8 is the lowermost layer in the inductor 1.

Sixth Modified Example

Figure 10:
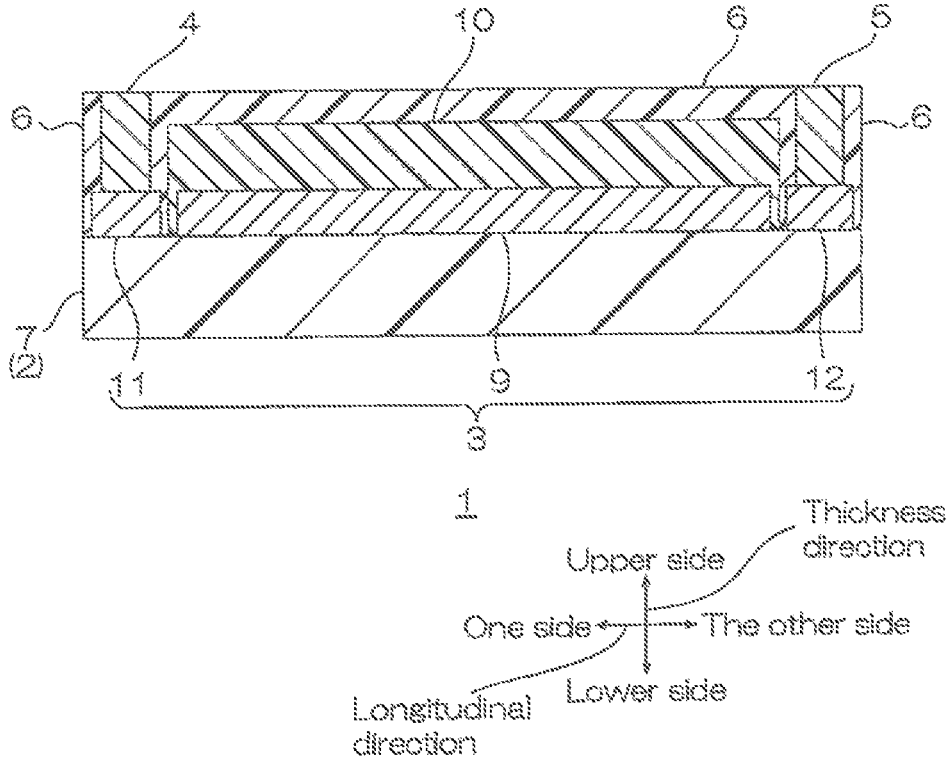
FIG. 10 shows a cross-sectional view of a sixth modified example of the inductor shown in FIG. 2.

As shown in FIG. 10, the inductor 1 does not include the base insulating layer 8 (ref: FIG. 2). The base layer 2 does not include the base insulating layer 8, and consists of only the second magnetic layer 7. The upper surface of the second magnetic layer 7 is a flat surface for disposing the conductive pattern 3 on the same plane. That is, the conductive pattern 3 is disposed on the upper surface of the second magnetic layer 7.

Seventh Modified Example

Figure 11:
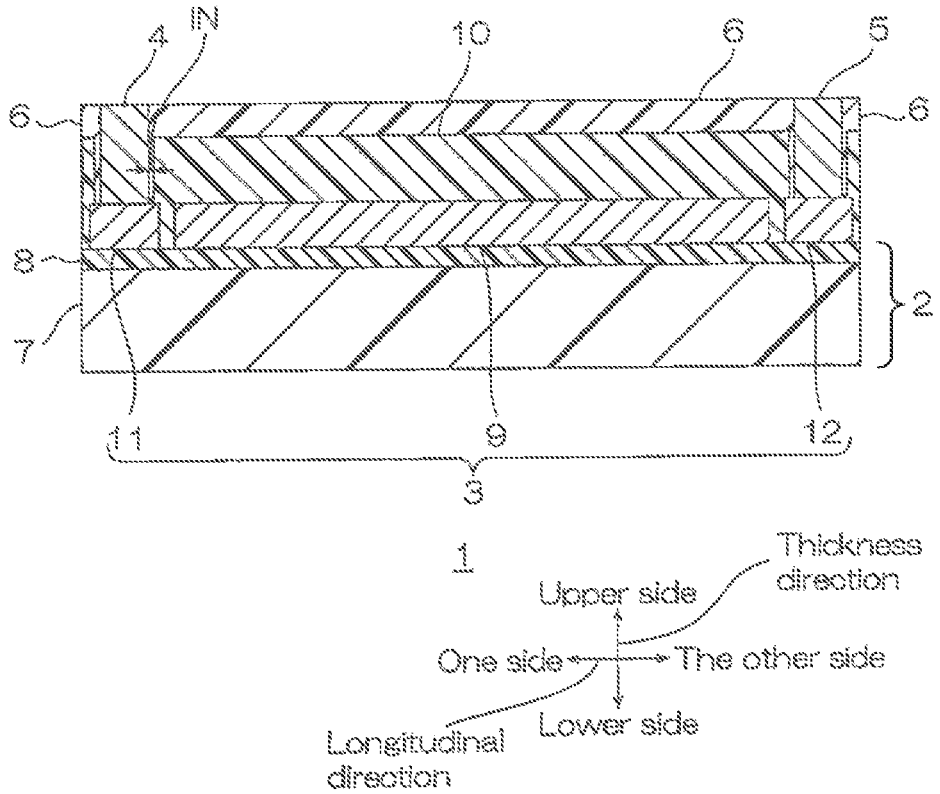
FIG. 11 shows a cross-sectional view of a seventh modified example of the inductor shown in FIG. 2.

As shown in FIG. 11, the magnetic layer 10 also covers the peripheral end portion of the first electrode 11 and that of the second electrode 12. In the seventh modified example, the magnetic layer 10 is spaced apart from the first bump 4 and the second bump 5 with the above-described gap IN therebetween in the longitudinal direction.

Eighth Modified Example

Figure 12:
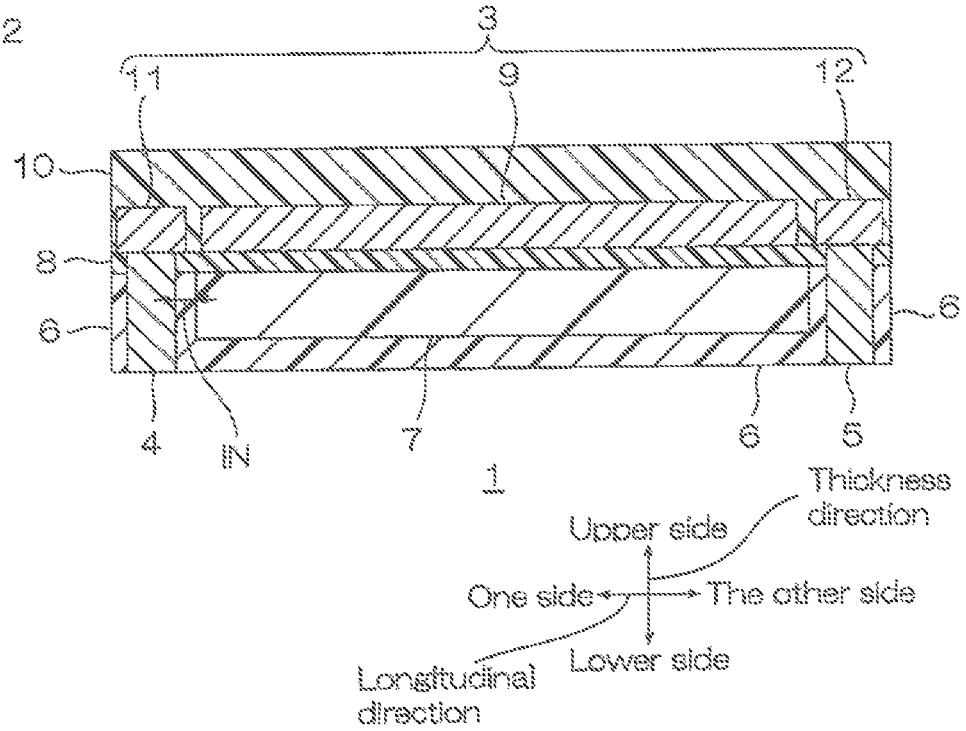
FIG. 12 shows a cross-sectional view of an eighth modified example of the inductor shown in FIG. 2.

As shown in FIG. 12, the first bump 4 and the second bump 5 are disposed at the lower side of the first electrode 11 and the second electrode 12, respectively. The first bump 4 and the second bump 5 are in contact with the lower surface of the first electrode 11 and that of the second electrode 12, respectively.

The cover insulating layer 6 is disposed below the base insulating layer 8. The cover insulating layer 6 covers the side surfaces of the first bump 4 and the second bump 5, and the lower surface and the side surfaces of the second magnetic layer 7. The cover insulating layer 6 is smaller than the base insulating layer 8 when viewed from the top.

The first bump 4 and the second bump 5 pass through the base insulating layer 8 and the cover insulating layer 6 in the thickness direction. The lower surfaces of the first bump 4 and the second bump 5 are flush with the lower surface of the cover insulating layer 6.

The second magnetic layer 7 is spaced apart from the first bump 4 and the second bump 5 with the gap IN therebetween in the longitudinal direction.

Ninth Modified Example

Figure 13:
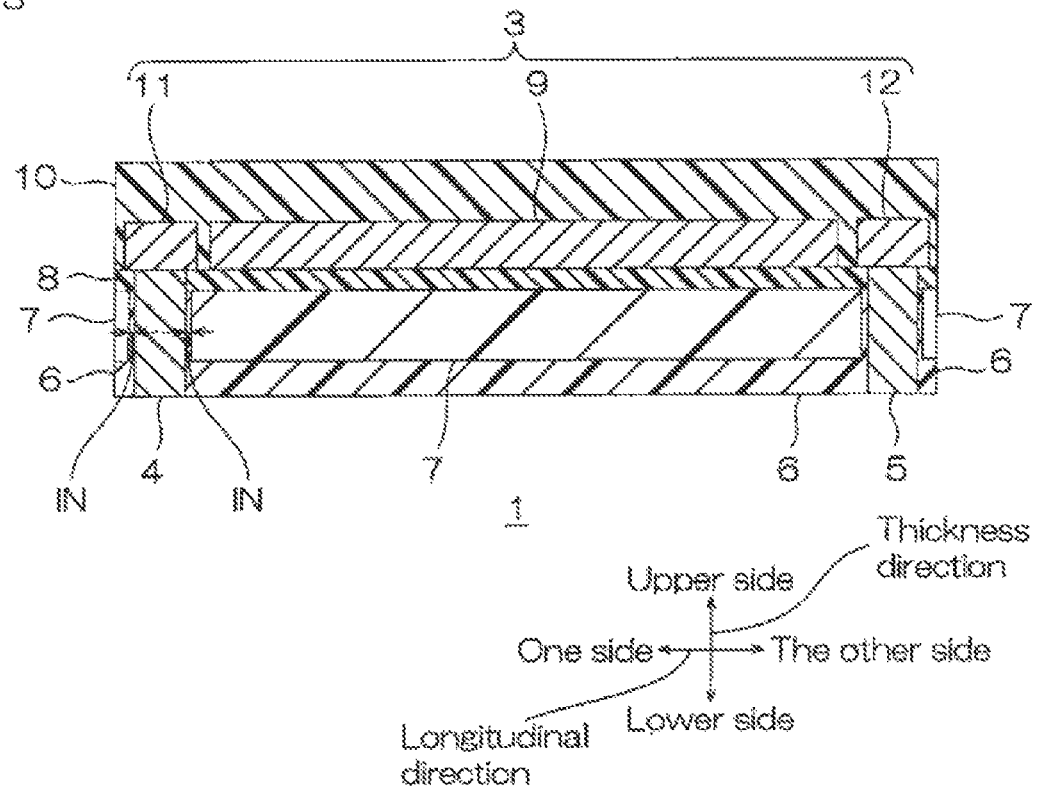
FIG. 13 shows a cross-sectional view of a ninth modified example of the inductor shown in FIG. 2.

As shown in FIG. 13, the first bump 4 and the second bump 5 are in contact with the lower surface of the first electrode 11 and that of the second electrode 12, respectively, and the second magnetic layer 7 covers the peripheral end portion of the first bump 4 and that of the second bump 5. In the ninth modified example, the second magnetic layer 7 is also spaced apart from the first bump 4 and the second bump 5 with the above-described gap IN therebetween in the longitudinal direction.

Tenth Modified Example

Figure 14:
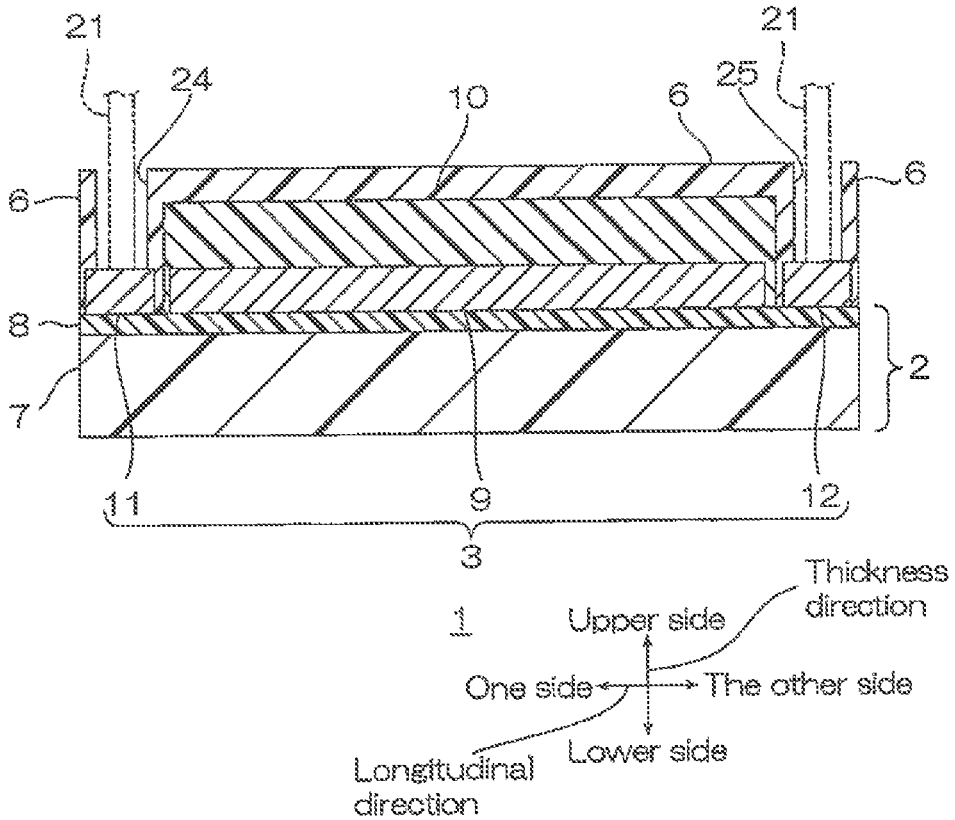
FIG. 14 shows a cross-sectional view of a tenth modified example of the inductor shown in FIG. 2.

As shown in FIG. 14, the inductor 1 does not include the first bump 4 and the second bump 5 (ref: FIG. 2). That is, the inductor 1 consists of only the base layer 2, the conductive pattern 3, the magnetic layer 10, and the cover insulating layer 6.

The cover insulating layer 6 has a first opening portion 24 and a second opening portion 25 that expose the central portion of each of the upper surfaces of the first electrode 11 and the second electrode 12.

The connecting member 21 is in contact with each of the upper surfaces of the first electrode 11 and the second electrode 12 via the first opening portion 24 and the second opening portion 25.

Other Modified Examples

Figure 16:
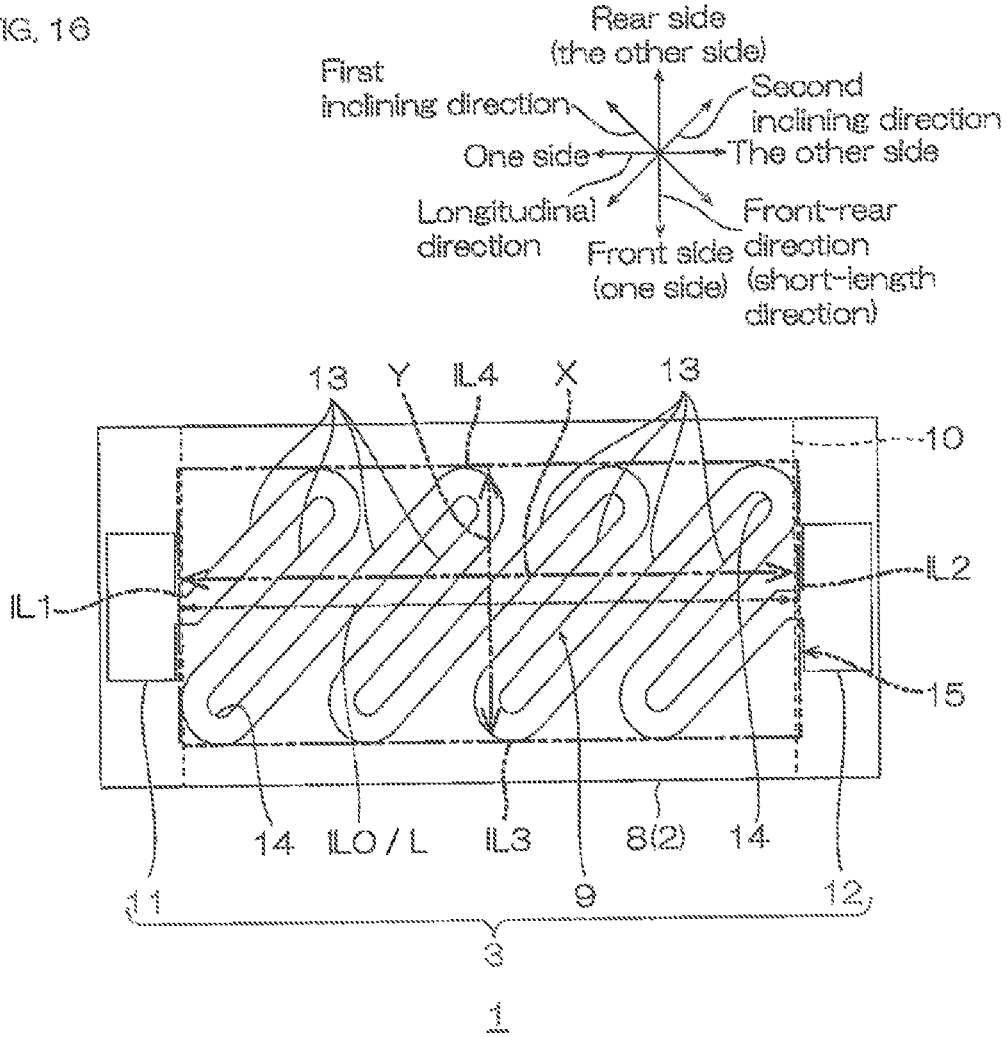
FIG. 16 shows a plan view of a further modified example of the fourth modified example of the inductor shown in FIG. 8.

In the one embodiment, the third phantom line segment IL3 and the fourth phantom line segment IL4 that define the wire area 15 are along the front end edge and the rear end edge of the first electrode 11 and the second electrode 12, respectively. Alternatively, for example, as shown in FIG. 16, as a further modified example of the fourth modified example, the third phantom line segment IL3 can be positioned at the front side with respect to the front end edges of the first electrode 11 and the second electrode 12, and the fourth phantom line segment IL4 can be positioned at the rear side with respect to the rear end edges of the first electrode 11 and the second electrode 12.

In the one embodiment, the conductive pattern 3 is formed by the subtractive method. Alternatively, though not shown, the conductive pattern 3 can be also formed on the upper surface of the base insulating layer 8 by an additive method using a film without preparing the conductive layer 16.

The inductor 1 can be also produced by either a roll-to-roll method or a paper sheet method.

In the one embodiment, as shown in FIG. 3D, the first bump 4 and the second bump 5 are provided, and thereafter, as shown in FIG. 3E, the cover insulating layer 6 is provided. Alternatively, though not shown, first, the cover insulating layer 6 is provided in a pattern of having the first opening portion 24 and the second opening portion 25, and thereafter, the first bump 4 and the second bump 5 can be also provided.

EXAMPLES

Next, the present invention is further described based on Examples and Comparative Examples. The present invention is however not limited by these Examples and Comparative Examples. The specific numerical values in mixing ratio (content ratio), property value, and parameter used in the following description can be replaced with upper limit values (numerical values defined as "or less" or "below") or lower limit values (numerical values defined as "or more" or "above") of corresponding numerical values in mixing ratio (content ratio), property value, and parameter described in the above-described "DESCRIPTION OF EMBODIMENTS".

Example 1

Figure 2:
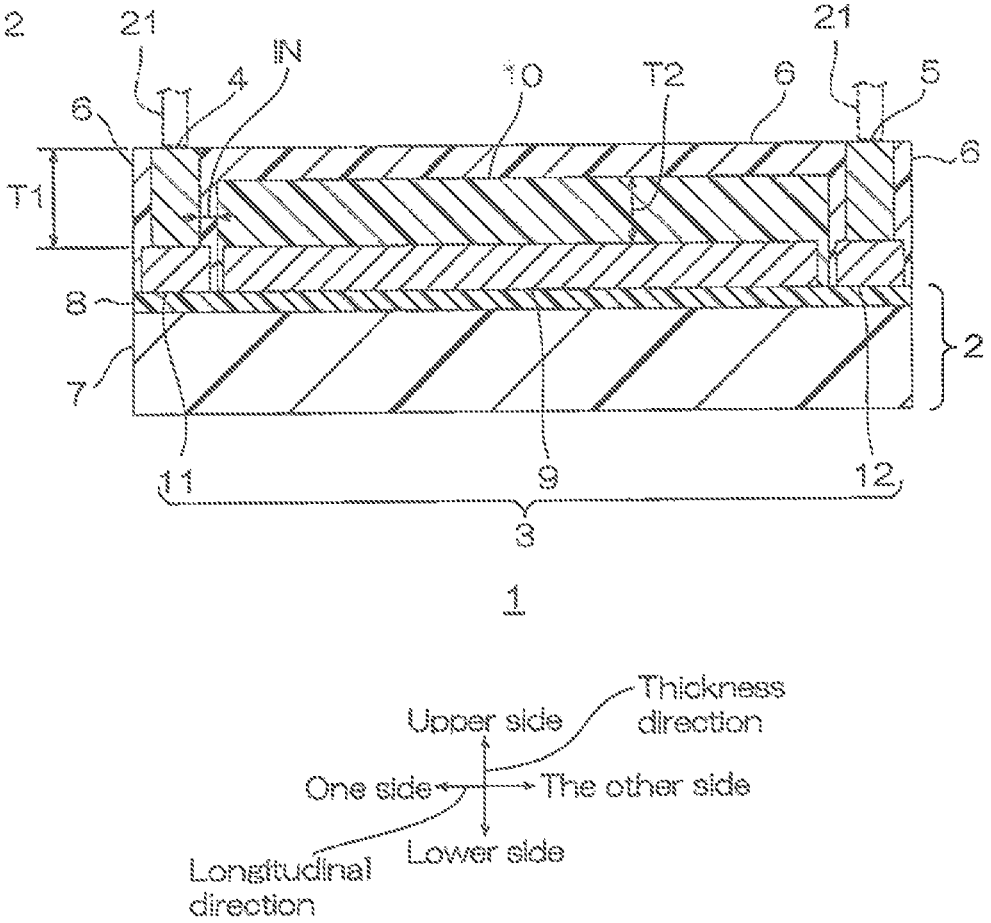
FIG. 2 shows a cross-sectional view along a C-C line of FIGS. 1A and 1B.

The inductor 1 of the one embodiment shown in FIGS. 1A to 2 was produced in accordance with the above-described producing method. The inductor 1 included the second magnetic layer 7, the base insulating layer 8, the conductive pattern 3, the first bump 4, the second bump 5, the magnetic layer 10, and the cover insulating layer 6.

The conductive pattern 3 included the first electrode 11, the second electrode 12, and the wire 9. A material for the conductive pattern 3 was copper, and the thickness thereof was 50 μm. A material for the first bump 4 and the second bump 5 was SnAgCu solder, and the thickness thereof was 140 μm.

Examples of the material for the second magnetic layer 7 and the magnetic layer 10 included the magnetic compositions described in Example 1 of Japanese Unexamined Patent Publication No. 2014-189015.

The size of the first electrode 11, the second electrode 12, and the wire 9; and the gap IN of the first bump 4 and the second bump 5, and the magnetic layer 10 were described in Table 1.

Example 2 to Comparative Example 1

The inductor 1 was prepared in the same manner as that of Example 1, except that the size or the like of the first electrode 11 and the second electrode 12 were changed to those described in Table 1.

Example 3 showed the inductor 1 of the first modified example shown in FIG. 5, and Comparative Example 1 showed the inductor 1 beyond the scope of the present invention shown in FIG. 15.

<Evaluation>

[Resistance]

Resistance R1 between the first electrode 11 and the second electrode 12 shown in FIGS. 3B and 4B in the middle of the production and resistance R2 between the first bump 4 and the second bump 5 in the obtained inductor 1 were measured by a four-terminal method. A percentage (R1/R2×100) of the resistance R1 between the first electrode 11 and the second electrode 12 with respect to the resistance R2 between the first bump 4 and the second bump 5 was calculated.

[Short Circuit]

A resistance value between the first bump 4 and the magnetic layer 10 was measured by a two-terminal method, and the short circuit properties (electrically conductive properties) between the first bump 4 and the magnetic layer 10 were evaluated as follows.

Excellent: 1 MΩ or more

Good: above 0.1 MΩ and below 1 MΩ

Bad: below 0.1 MΩ

TABLE 1

| Ex.-Comparative Ex. | | | Ex. 1 | Ex. 2 | Ex. 3 | Ex. 4 | Comparative Ex. 1 |
|---|---|---|---|---|---|---|---|
| Wire Area | Length X in Longitudinal | μm | 900 | 900 | 900 | 900 | above 900 |
| | Length Y in Front-Rear Direction | μm | 400 | 400 | 400 | 400 | 400 |
| | X/Y Ratio | μm | 2.25 | 2.25 | 2.25 | 2.25 | above 2.25 |
| Wire | Width w | μm | 85 | 85 | 85 | 85 | 85 |
| | $w^2$ | $\mu m^2$ | 7225 | 7225 | 7225 | 7225 | 7225 |

TABLE 1-continued

| Ex.-Comparative Ex. | | | Ex. 1 | Ex. 2 | Ex. 3 | Ex. 4 | Comparative Ex. 1 |
|---|---|---|---|---|---|---|---|
| First Electrode | Short Side SS1 | μm | 100 | 50 | 100 | 100 | 80 |
| | Long Side LS1 | μm | 400 | 400 | 250 | 400 | 80 |
| | Plane Area S1 (=SS1 × LS1) | $\mu m^2$ | 40000 | 20000 | 25000 | 40000 | 6400 |
| Second Electrode | Short Side SS2 | μm | 100 | 50 | 100 | 100 | 80 |
| | Long Side LS2 | μm | 400 | 400 | 250 | 400 | 80 |
| | Plane Area S2 (=SS2 × LS2) | $\mu m^2$ | 40000 | 20000 | 25000 | 40000 | 6400 |
| Overlapping Length of First Electrode and Second Electrode when Projected in Longitudinal Direction | | μm | 400 | 400 | 100 | 400 | 0 |
| Gap IN between First Electrode and Magnetic Layer | | μm | 0.15 | 0.14 | 0.17 | 0.06 | 0.15 |
| Evaluation | Resistance R1 between First Electrode and Secend Electode/ Resistance R2 between First Bump and Second Bump × 100 | % | 4 | 8 | 7 | 4 | 26 |
| | Short Circuit between First Bump and Magnetic Layer | — | Excel-lent | Excel-lent | Excel-lent | Good | Excel-lent |

While the illustrative embodiments of the present invention are provided in the above description, such is for illustrative purpose only and it is not to be construed as limiting the scope of the present invention. Modification and variation of the present invention that will be obvious to those skilled in the art is to be covered by the following claims.

INDUSTRIAL APPLICABILITY

The inductor of the present invention is, for example, used as a passive element.

DESCRIPTION OF REFERENCE NUMERALS

1 Inductor
4 First bump
5 Second bump
6 Cover insulating layer
7 Second magnetic layer
8 Base insulating layer
9 Wire
10 Magnetic layer
11 First electrode
12 Second electrode
15 Wire area
18 Unit
19 Magnetic sheet
BS1 Plane area of first bump
BS2 Plane area of second bump
IN Gap between magnetic layer, and first bump and second bump
L Length between first electrode and second electrode along longitudinal direction (shortest direction)
S1 Plane area of first electrode
S2 Plane area of second electrode
T1 Thickness of first bump and second bump
T2 Thickness of magnetic layer
X Length in longitudinal direction
Y Length in front-rear direction
W Width
$W^2$ Square value of width

The invention claimed is:

1. An inductor comprising:

a wire having a width W, and a first electrode and a second electrode continuous to each of both ends of the wire, wherein the wire, the first electrode, and the second electrode are present on a same plane;

the plane area S1 of the first electrode and the plane area S2 of the second electrode are a square value ($W^2$) or more of the width W;

an area in which the wire is disposed is positioned between the first electrode and the second electrode;

the area has a length X in a longitudinal direction equal to a length L between the first electrode and the second electrode along a facing direction of the first electrode and the second electrode, and a length Y in a short-length direction in a direction perpendicular to the longitudinal direction;

the length X in the longitudinal direction is 1.5 times or more of the length Y in the short-length direction;

a magnetic layer having an upper surface and a lower surface, the lower surface covering the wire in the longitudinal direction and with one edge and the other edge of the magnetic layer positioned facing a side edge of each of the first electrode and the second electrode, respectively;

a first bump disposed and in direct contact with an upper surface of the first electrode in a thickness direction of the first electrode; and a second bump disposed and in direct contact with an upper surface of the second electrode in a thickness direction of the second electrode, and wherein the magnetic layer is spaced apart from the first bump and the second bump by a gap of 0.1 μm or more in the longitudinal direction.

2. The inductor according to claim 1, wherein the magnetic layer has a thickness of 500 μm or less.

3. The inductor according to claim 1, wherein a ratio of the plane area BS1 of the first bump to the plane area S1 of the first electrode is 70% or more, and a ratio of the plane area BS2 of the second bump to the plane area S2 of the second electrode is 70% or more.

4. The inductor according to claim 1, wherein a length in the thickness direction of the first bump and the second bump is longer than a thickness of the magnetic layer.

5. The inductor according to claim 1 further comprising: a cover insulating layer covering surroundings of the first bump and the second bump and disposed at a one side in the thickness direction of the wire, the first electrode, and the second electrode.

6. The inductor according to claim 1 further comprising: a base insulating layer disposed on an other-side surface in the thickness direction of the wire, and a second magnetic layer disposed on the other-side surface in the thickness direction of the base insulating layer.

7. A method for producing an inductor according to claim 1 comprising the steps of:

producing a plurality of units each including one wire, one first electrode, and one second electrode along one direction in a plane direction;

disposing a long-length magnetic sheet being long in the one direction with respect to the plurality of units so as to collectively cover one-side surfaces in a thickness direction of the plurality of wires in the plurality of units to form magnetic layers from the magnetic sheet; and cutting the magnetic layers along a direction crossing the one direction to singulate the plurality of units;

positioning a magnetic layer having an upper surface and a lower surface, the lower surface covering the wire in the longitudinal direction, and with one edge and the other edge of the magnetic layer positioned facing a side edge of each of the first electrode and the second electrode, respectively;

disposing a first bump in direct contact with an upper surface of the first electrode in the thickness direction of the first electrode; and disposing a second bump in direct contact with an upper surface of the second electrode in the thickness direction of the second electrode, and spacing apart the magnetic layer from the first bump and the second bump by a gap of 0.1 μm or more in the longitudinal direction.

* * * * *